US006085064A

United States Patent [19]

Nagase et al.

[11] Patent Number: 6,085,064

[45] Date of Patent: Jul. 4, 2000

[54] IMAGE FORMING APPARATUS

[75] Inventors: Hisayoshi Nagase; Kunio Shigeta; Satoshi Haneda; Yotaro Sato, all of Hachioji; Toshihide Miura, Koganei, all of Japan

[73] Assignee: Konica Corporation, Tokyo, Japan

[21] Appl. No.: 09/158,472

[22] Filed: Sep. 22, 1998

[30] Foreign Application Priority Data

| | | | |
|---|---|---|---|
| Sep. 24, 1997 | [JP] | Japan | 9-258622 |
| Sep. 24, 1997 | [JP] | Japan | 9-258623 |
| Sep. 30, 1997 | [JP] | Japan | 9-266270 |

[51] Int. Cl.[7] ..... G03G 15/14

[52] U.S. Cl. ..... 399/399; 271/311; 399/400

[58] Field of Search ..... 399/122, 124, 399/297, 302, 308, 309, 397, 398, 399, 400; 271/273, 274, 307, 311, 314

[56] References Cited

U.S. PATENT DOCUMENTS

| | | | |
|---|---|---|---|
| 4,792,824 | 12/1988 | Kozuka | 399/148 |
| 5,778,291 | 7/1998 | Okubo et al. | 399/302 |
| 5,826,143 | 10/1998 | Haneda et al. | 399/182 |

FOREIGN PATENT DOCUMENTS

| | | |
|---|---|---|
| 49-37538 | 10/1974 | Japan . |
| 54-28740 | 9/1979 | Japan . |
| 64-44457 | 2/1989 | Japan . |
| 4-214576 | 8/1992 | Japan . |
| 9-258492 | 10/1997 | Japan . |

*Primary Examiner*—William Royer
*Assistant Examiner*—William A. Noe
*Attorney, Agent, or Firm*—Frishauf, Holtz, Goodman, Langer & Chick, P.C.

[57] ABSTRACT

An image forming apparatus includes: a first image carrier for carrying a toner image formed by an toner image forming device; a second image carrier for carrying thereon the toner image transferred from the first image carrier, and for transferring a transfer sheet thereon; a first transfer device for transferring the toner image carried on the first image carrier onto the second image carrier or a front side of the transfer sheet; a second transfer device for transferring the toner image carried on the second image carrier onto a back side of the transfer sheet; a fixing device for fixing the toner image transferred on the transfer sheet, wherein the second image carrier has a curvature portion at an edge thereof facing the fixing device; and a conveyance section provided between the curvature portion and the fixing device, having a claw member provided adjacent to the curvature portion for lifting a leading edge of the transfer sheet conveyed along the curvature portion. The claw member is separated from the curvature portion, interlocking with retreat of the conveyance section.

23 Claims, 21 Drawing Sheets

FIG. 3 ( A )
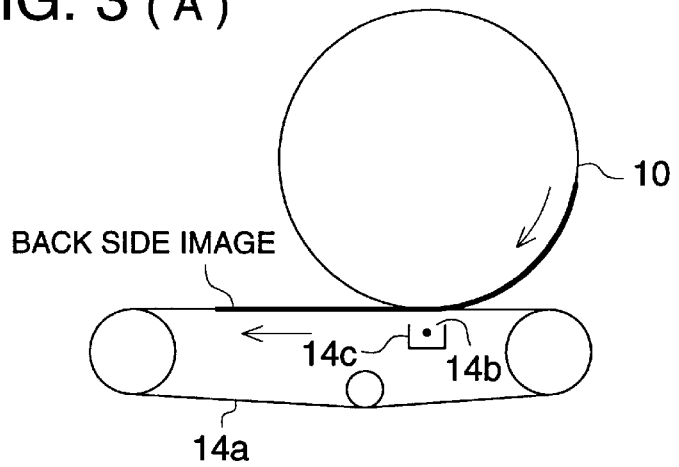
FIG. 3 ( B )
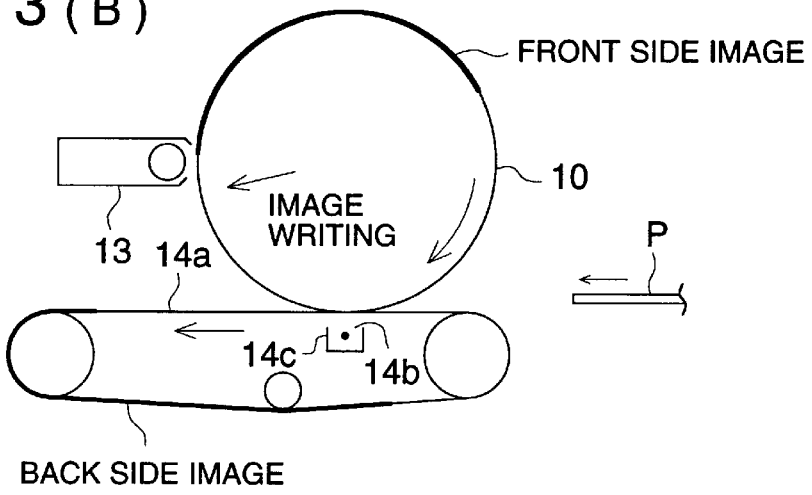
FIG. 3 ( C )
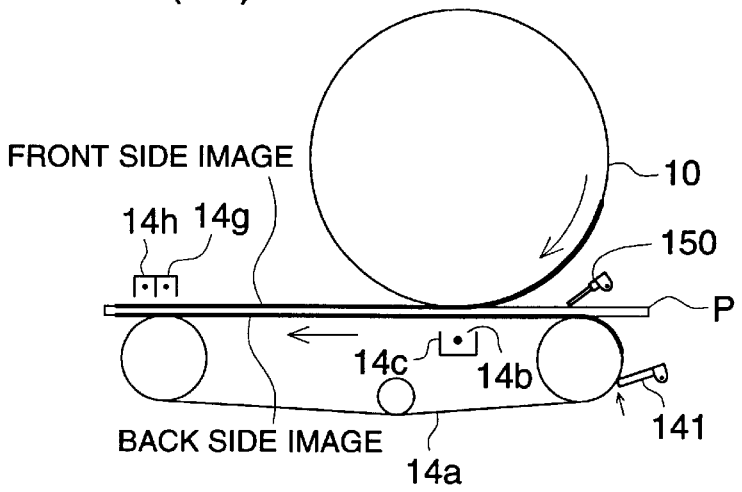

FIG. 16 ( a )
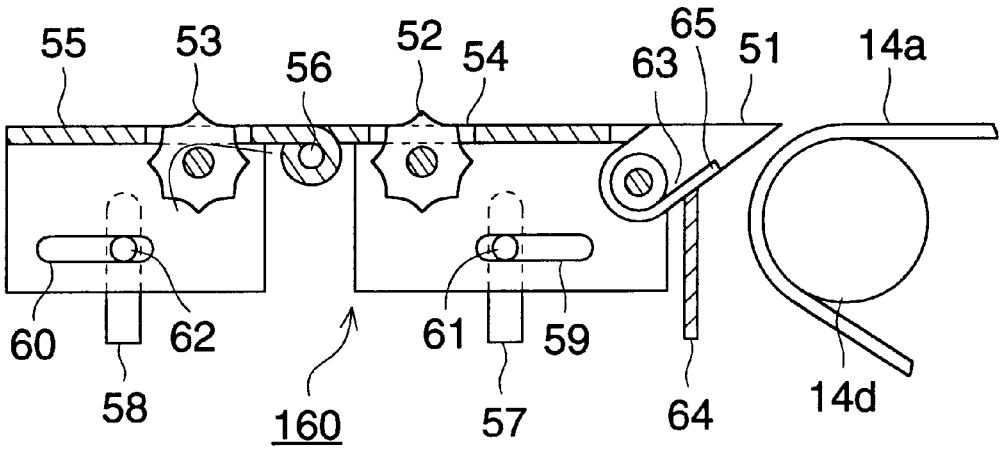
FIG. 16 ( b )
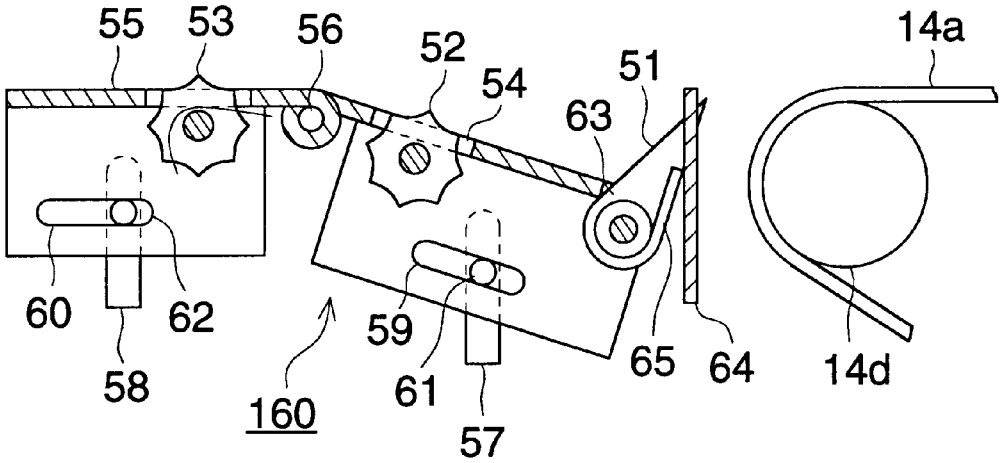

IMAGE FORMING APPARATUS

The present invention relates to an electrophotographic type image forming apparatus such as a copier, printer, facsimile device, or the like, in which a charging means, an image exposing means and a developing means are arranged around an image bearing body, and a toner image formed on the image bearing body is transferred onto a transfer-material and fixed.

Conventionally, in double-sided image formation, a method is adopted in which a single-sided image formed on the image bearing body is transferred onto a transfer material and fixed; the transfer material is temporarily accommodated in an intermediate tray; the transfer material is fed from the intermediate tray in timed relationship with an image formed again on the image bearing body; and the image is then transferred onto the other side of the transfer material and fixed.

As described above, in this double-sided image forming apparatus, the transfer material is fed to the intermediate tray and the transfer material is conveyed in such a manner that it passes through the fixing device twice, thereby, reliability of the transfer material conveyance is low, resulting in a cause of jamming or wrinkling of the transfer material. In contrast to this, a method in which, after toner images are formed on both sides of the transfer material, fixing is carried out only once, is proposed in Japanese Patent Publication Nos. 49-37538 and 54-28740, Japanese Tokkaihei Nos. 1-44457, and 4-214576. Specifically, in Japanese Tokkaihei Nos. 1-44457 and 4-214576, methods in which plural sets of image forming means composed of an image bearing, a charging means, an image exposure and a developing means are located on a toner image receiving body in parallel so that a color image double-sided copy is formed are proposed. The present inventors studied the practicality of aforesaid double-sided image forming system. They have applied numerous patent applications including Japanese Tokkaihei No. 9-25842.

In addition, the present inventors have been studying a double-sided image forming method in which a toner image formed on the image bearing body (the first image bearing means) is collectively and temporarily transferred onto a belt-shaped toner image receiving body (the second image bearing means), another toner image is formed on the image bearing body again and then, the toner image on the toner image receiving body and the toner image formed on the image bearing body are transferred onto both sides of a recording paper (transfer sheet). However, depending upon the kind of transfer sheet, conveyance of a transfer sheet separated from the belt-shaped toner image receiving body is not favorably conducted so that the transfer sheet does not advance to the fixing means smoothly, resulting in that the toner image on the transfer sheet is disturbed.

For solving aforesaid problem, the present inventors have been studying the conveyance of the transfer sheet to the fixing means in which a claw member which lifts the transfer sheet separated from the toner image receiving body and the conveyance section (it is preferable to provide the spurred wheel) are provided between the toner image receiving body and the fixing means. By providing a claw member between the toner image receiving body and the fixing means, separability can be more assured. If the spurred wheel is provided in the conveyance section, the transfer sheet having the toner image on both sides can also be conveyed favorably. However, if a conveyance problem (jamming) occurs due to providing aforesaid members, the following problems will occur.

(1) Since the back side of the transfer sheet carries an unfixed toner image, a hand is blackened when the hand is inserted into the machine for removing a jammed paper.

(2) Even if the claw member is used, in the case of a separation jamming in which separation of the transfer sheet from the toner image receiving body is not properly conducted, the transfer sheet is engaged by the claw member (separation claw). Therefore, it is difficult to remove the transfer sheet. If the engaged jammed paper is pulled forcibly, the jammed paper may be torn and, in addition, the claw member may also be damaged. In addition, there is also a danger that the transfer sheet is jammed onto the claw member so that the toner image receiving body is damaged by the wrinkled transfer sheet.

(3) If the spurred wheel is provided in the conveyance section, in the case of conveyance jamming in which the transfer sheet is engaged by the spurred wheel during conveyance, it is difficult to remove the transfer sheet. There is a fear that the spurred wheel could be damaged. In addition, the spurred wheel is contaminated so that black spots soilage is caused on the transfer sheet produced thereafter.

An objective of the present invention is to provide an image forming apparatus in which aforesaid problems items (1) through (3) have been solved.

The above-mentioned objective is attained by an image forming apparatus having the following constitution.

A first image carrying means carries a toner image formed by a toner image forming means. A second image carrying means carries thereon the toner image transferred from the first image carrying means and transfers a transfer material thereon. A first transfer means transfers the toner image carried on the first image carrying means onto the second image carrying means or a front side of the transfer material. A second transfer means transfers the toner image carried on the second image carrying means onto a back side of the transfer material. A fixing means fixes the toner images transferred on the transfer material, wherein the second image carrying means has a curved portion at an edge thereof facing the fixing means. And a conveyance section, provided between the curved portion and the fixing means, has a claw member provided adjacent to the curved portion for lifting a leading edge of the transfer material conveyed along the curved portion, wherein the claw member is separated from the curved portion when the conveyance section is moved away from the second image carrying means.

BRIEF DESCRIPTION OF THE DRAWINGS

FIGS. 3(*a*), 3(*b*) and 3(*c*) are drawings showing toner image forming status on both sides of an image forming apparatus of the present invention.

FIGS. 16(*a*) and 16(*b*) show side views of the conveyance section in the image forming apparatus of the embodiment shown in FIG. 15.

DETAILED DESCRIPTION OF THE PREFERRED EMBODIMENT

Hereinafter, an embodiment of the present invention will be explained. Incidentally, in the description of the following examples, the surface of a transfer sheet on a side facing the first image bearing means in a transfer area is referred to as a front side, a surface of the transfer sheet on the other side, that is on the side facing the second image bearing means (referred to also as an intermediate transfer body), is referred to as a back side, an image transferred onto the front side of the transfer sheet is referred to as the front side image, and an image transferred onto the back side of the transfer sheet is referred to as the back side image.

Figure 1:
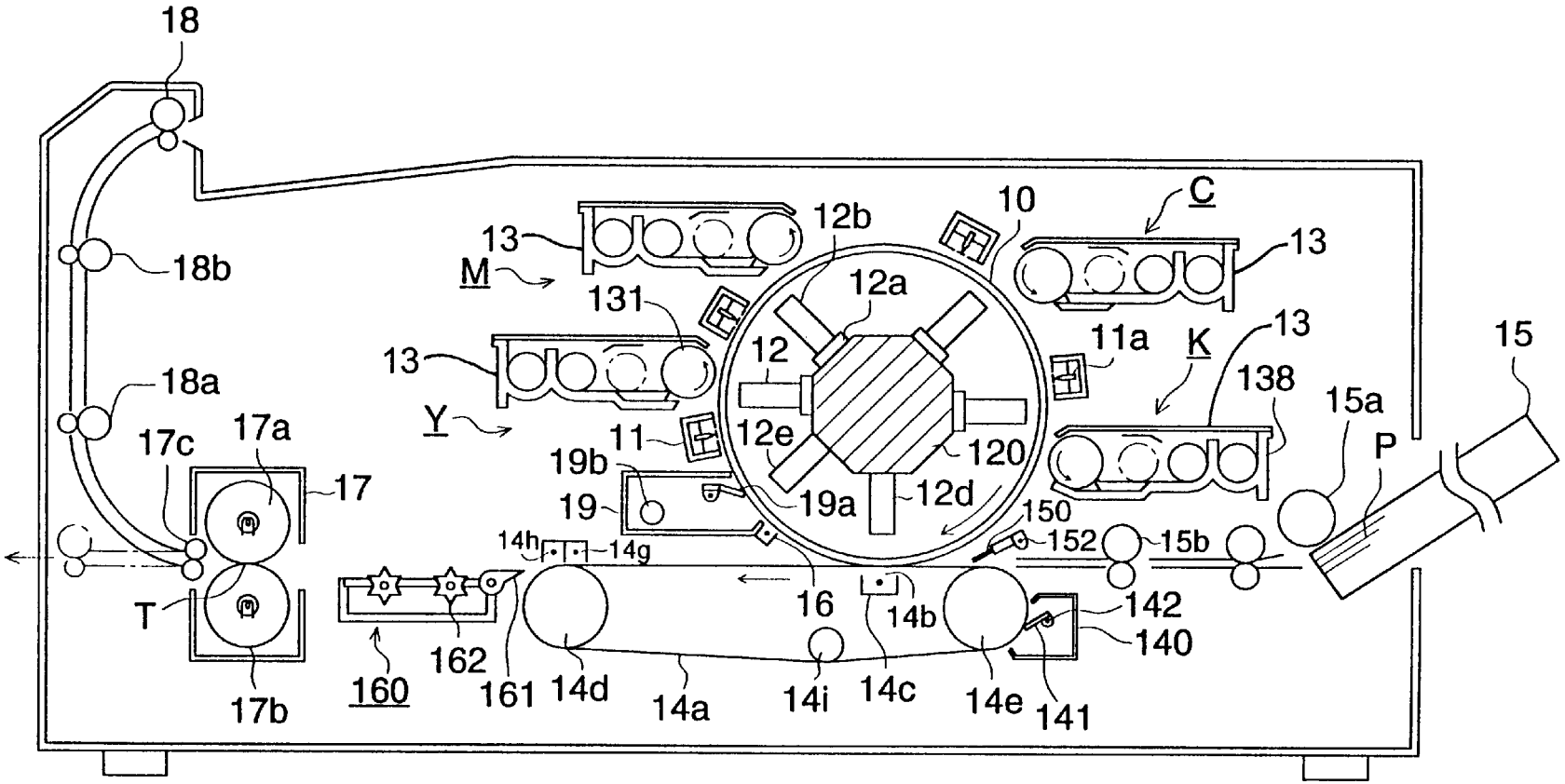
FIG. 1 is a cross sectional view of a color image forming apparatus showing one embodiment of an image forming apparatus of the present invention.
Figure 2:
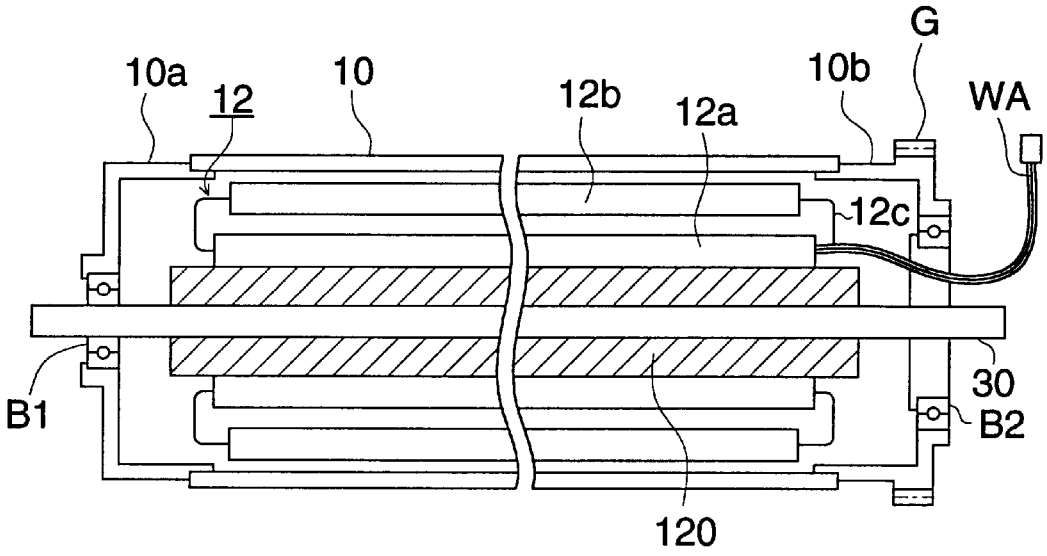
FIG. 2 shows a cross sectional side view of an image bearing means in FIG. 1.

Referring to FIG. 1 through FIG. 3(*c*), an image forming process and each mechanism of an example of an image forming apparatus according to the present invention will be explained. FIG. 1 is a sectional structural view of a color image forming apparatus showing an example of an image forming apparatus according to the present invention. FIG. 2 is a cross sectional side view of the first image bearing means in FIG. 1. FIGS. 3(*a*), 3(*b*) and 3(*c*) are views showing toner image forming conditions on both sides in the image forming apparatus according to the present invention. FIG. 3(*a*) is a view in which the toner image formed on the first image bearing means is transferred onto the second image bearing means and the back side image is formed. FIG. 3(*b*) is a view in which the front side image is formed on the first image bearing means in timed relationship with the back side image on the second image bearing means. FIG. 3(*c*) is a view showing both side image formation onto the transfer sheet.

In FIG. 1, numeral 10 is a photoreceptor drum serving as the first image bearing means, numeral 11 is a scorotron charger serving as a charging means for each color, numeral 12 is an exposure optical system serving as an image writing means for each color, numeral 13 is a developing device serving as a developing means for each color, numeral 14*a* is a toner image receiving body serving as the second image bearing means, numeral 14*c* is a transferring device serving as a first transferring means, numeral 14*g* is a back side transferring device serving as a second transferring means, numeral 150 is a paper charger serving as a transfer sheet charging means, numeral 14*h* is a paper separation AC discharger serving as a transfer sheet separating means, numeral 160 is a conveying section, and numeral 17 is a fixing device serving as a fixing means.

Photoreceptor drum 10 which is the first image bearing means, is structured in such a manner that a photoreceptor layer such as a transparent conductive layer, an a-Si layer or an organic photoreceptor layer (OPC) is formed on the outer periphery of a cylindrical base body formed of a transparent member such as, for example, optical glass, transparent acrylic resin, or the like, and is rotated clockwise as shown by an arrow in FIG. 1, while the conductive layer is electrically grounded.

As shown in FIG. 2, the photoreceptor drum 10 is rotatably supported by bearings B1 and B2, which are embedded in flange members 10*a* and 10*b* on both end portions with which photoreceptor drum 10 is engaged for being fixed, with respect to drum shaft 30 affixed to the apparatus main body, and is rotated at constant speed in a predetermined direction when a gear G integrated with flange member 10*b* is engaged with a driving gear, not shown, on the apparatus main body side and is driven.

Scorotron charger 11 which is a charging means for each color, exposure optical system 12 which is the image writing means for each color, and developing device 13 which is the developing means for each color are formed into a set, and 4 such sets are prepared for the image forming process for each color of yellow (Y), magenta (M), cyan (C) and black (K) and are arranged in the order of Y, M, C, K in the rotational direction of photoreceptor drum 10 as shown by an arrow in FIG. 1.

The scorotron charger 11 for each color incorporates a control grid having a predetermined potential voltage and a discharging electrode 11*a* formed of, for example, a saw tooth-shaped electrode, and is mounted facing the photoreceptor layer of photoreceptor drum 10, conducts charging action (negative charging in the present example) by corona discharging with the same polarity as the toner, and applies uniform potential voltage onto photoreceptor drum 10. As discharging electrode 11*a*, a wire electrode or a needle-shaped electrode may be used.

Exposure optical system 12 which is the image writing means for each color is located inside the photoreceptor drum 10 in such a manner that the exposure position on photoreceptor drum 10 is positioned downstream in the rotational direction of the photoreceptor drum 10 with respect to the above-described scorotron charger 11 for each color. As shown in FIG. 2, each exposure optical system 12 is an exposure unit structured of a linear exposure element 12*a* in which a plurality of LEDs (light emitting diodes) as a light emitting element of image exposure light are arranged array-like in the primary scanning direction parallel to drum shaft 30, light converging light transmission body 12*b* (trade name: Selfoc lens array) as an image forming element, and lens holder 12*c,* and mounted on a holding member 120. Other than exposure optical system 12 for each color, transfer simultaneous exposure unit 12*d* and uniform exposure unit 12*e* are also mounted on the holding member 120, being integrally accommodated inside the light transmissive base body of photoreceptor drum 10. Exposure optical systems 12 for each color image-wise exposes the photoreceptor layer of the photoreceptor drum from its back side according to image data for each color which is read by an image reading device separately provided from the apparatus and stored in a memory, and forms an electrostatic latent image on the photoreceptor drum 10. As exposure element 12*a,* in addition to the above element, an exposure element may also be used in which arrays of light emitting elements such as an FL (fluorescent substance light emission), EL (electroluminescence), PL (plasma discharge), etc., are arranged. As the wavelength of light emission of the light emitting element for image-wise exposure light, a wavelength within the range of 780–900 nm having a light transmissivity to Y, M and C toners is normally used. However, in the present example, image-wise exposure is conducted from the back side. Therefore, a wavelength within the range of 400–780 nm not having as high a light transmissivity may also be used.

Developing device 13 which is the developing means for each color has a developing sleeve 131 which keeps a predetermined gap with respect to the circumferential surface of photoreceptor drum 10 and which is formed of, for example, a 0.5–1 mm thick and 15–25 mm outer diameter cylinder of non-magnetic stainless steel or aluminum material and is rotated in the same direction as the rotational direction of the photoreceptor drum 10, and, further, a developing casing 138, and one-component or two-component developer of yellow (Y), magenta (M), cyan (C) and black (K) is accommodated therein. Each developing device 13 is kept in a non-contact with photoreceptor drum 10 at a predetermined gap of, for example, 100–500 ƒÊm, and when developing bias voltage in which an AC voltage is superimposed on a DC voltage, is applied on developing sleeve 131, non-contact reversal development is conducted and a toner image is formed on photoreceptor drum 10.

Toner image receiving body 14*a* which is the second image bearing means is an endless belt having $10^{12}$–$10^{15}$ ƒ¶Σcm volume resistivity, and two-layer construction seamless belt in which, for example, preferably, as a toner filming prevention layer, 5–50 ƒÊm fluorine coating is made outside 0.1–1.0 mm semi-conductive film base body which is formed by dispersing conductive material in engineering plastic such as modified polyimide, thermosetting polyimide, ethylene-tetrafluoro ethylene copolymer, polyvinyliden fluoride, nylon alloy, etc. As the base body of the belt, other than the above, 0.1–2.0 mm thick semi-conductive rubber belt which is formed by dispersing conductive material in silicon rubber or urethane rubber, may also be used. The toner image receiving body 14*a* is inscribed by drive roller 14*d* which is a roller member, driven roller 14*e,* and tension roller 14*i,* trained around them, and rotated counterclockwise as shown by an arrow in FIG. 1. These rollers are provided in the following order; driven roller 14*e,* drive roller 14*d,* tension roller 14*i,* and in the rotational direction of toner image receiving body 14*a,* and the driven roller, drive roller 14*d* and are rotated at a fixed position, and tension roller 14*i* is rotated while stretching toner image receiving body 14*a* by a spring force of a spring or the like, not shown, of the toner image receiving body 14*a.* When a drive motor (not shown) rotates drive roller 14*d* is rotated, and the toner image receiving body 14*a* is, thereby, rotated. By the rotation of toner image receiving body 14*a,* driven roller 14*e,* guide roller 14*f,* and tension roller 14*i* are also driven. Any slack of the belt of the toner image receiving body 14*a* during rotation, is taken up by tension roller 14*i.*

Transferring device 14*c* which is the first transferring means, is provided opposite to the photoreceptor drum 10 through the toner image receiving body 14*a,* and transfer area 14*b* is formed between toner image receiving body 14*a* and photoreceptor drum 10. DC voltage with a polarity opposite that of the toner (in the present example, a positive polarity) is applied onto the transferring device 14*c,* and by forming the transfer electrical field in the transfer area 14*b,* the toner image on photoreceptor drum 10 is transferred onto the toner image receiving body 14*a* or onto the front side of a recording sheet P which is a transfer sheet.

The back side transferring device 14*g* which is the second transferring means, is provided opposite to the conductive drive roller 14*d* which is electrically grounded through the toner image receiving body 14*a,* and DC voltage with a polarity opposite that of the toner (in the present example, a positive polarity) is applied onto the back side transferring device 14*g,* thereby, the toner image on the toner image receiving body 14*a* is transferred onto the back side of the recording sheet P.

Paper charger 150 which is a transfer sheet charging means is provided opposite to the electrically grounded driven roller 14*e* through toner image receiving body 14*a,* and recording sheet P is charged and attracted to toner image receiving body 14*a.*

Paper separation AC discharger 14*h* as a transfer sheet separation means, is provided as needed opposite to the electrically grounded conductive drive roller 14*d* through the toner image receiving body 14*a* at one of the end portions of the toner image receiving body 14*a* on the fixing device 17 side, and an AC voltage on which a DC voltage with the same polarity as or the opposite polarity to toner is superimposed at need is applied on the paper separation AC discharger 14*h* and the recording sheet P conveyed by toner image receiving body 14*a* is discharged and separated from toner image receiving body 14*a.*

The conveying section 160 is provided between toner image receiving body 14*a* and fixing device 17, and separation claw 161 and spurred wheel 162 are provided on the upper surface of aforesaid conveying section 160. The separation claw 161 and the spurred wheel 162 lift the recording sheet P which is going to be conveyed while being bent toward toner image receiving body 14*a* when recording sheet P is separated from toner image receiving body 14*a,* and convey the recording sheet P with the toner image on its back side to fixing device 17 while preventing the back side toner image from being disturbed.

Figure 24:
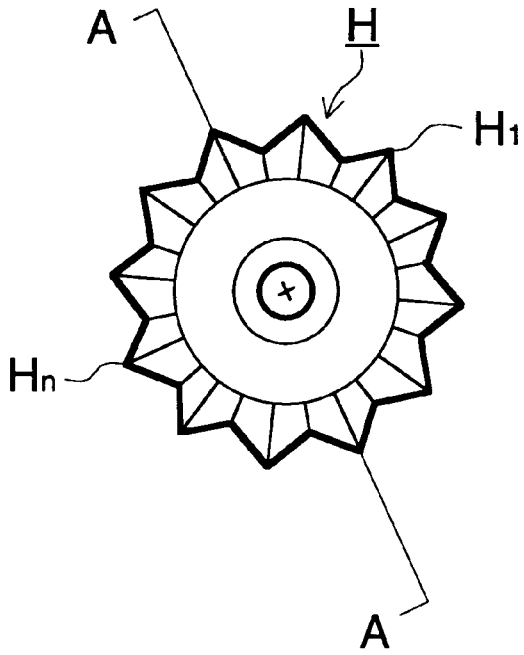
FIGS. 24(*a*) and 24(*b*) are drawings showing a guiding means in the embodiment of the present invention.
Figure 24:
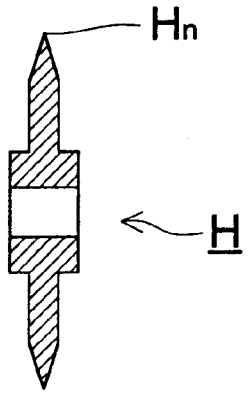

Here, spurred wheels, which are guiding means for the transfer material which carries unfixed toner images on both sides will be explained referring to FIGS. 24(*a*) and 24(*b*). FIG. 24(*b*) is the A—A cross sectional view of FIG. 24(*a*).

As shown in FIG. 24(*a*) and 24(*b*), spurred wheels H are guiding members which have numerous tips $H_1 \ldots H_n$ and which are supported on a low friction shaft in such a manner as to be able to rotate freely when receiving external force. Spurred wheels H are formed so that the area contacting the transfer material is extremely small and can guide the transfer material without disturbing the unfixed toner images. In FIG. 1, two pieces of spurred wheels H are located parallel to the conveyance direction of the transfer material. However, the number may be increased/decreased as needed. With regard to a direction perpendicular to the direction of conveyance, i.e., in the lateral direction of the transfer material, it is preferable to locate three rows, i.e., both ends and the center or five rows in which spurred wheels are located between each end and the center too in addition to both ends and the center.

Fixing device 17, which is a fixing means, having a heater inside both rollers respectively, is constituted of two rollers, i.e., fixing roller 17*a* which is a fixing member for the top side (the front side) and fixing roller 17*b* which is a fixing member for the bottom side (the back side) wherein both fixing rollers rotate as a pair. By adding heat and pressure between fixing roller 17*a* and fixing roller 17*b,* toner images on the transfer material are fixed.

Next, the image forming process will be described.

When image recording is started, the photoreceptor drum 10 is rotated clockwise as shown by an arrow in FIG. 1, by the start of a photoreceptor drum driving motor, not shown in the drawings, and simultaneously, potential voltage starts to be applied on the photoreceptor drum 10 by a charging action of a yellow (Y) scorotron charger 11.

After potential voltage has been applied onto the photoreceptor drum 10, image writing by an electrical signal corresponding to the first color signal, that is, Y image data is started by the Y exposure optical system 12, and an electrostatic latent image corresponding to the Y image of the document image is formed on the surface of the photoreceptor drum 10.

The above-mentioned latent image is reversal-developed under non-contact condition by the Y developing device 13, and a yellow (Y) toner image is formed in accordance with the photoreceptor drum 10.

Next, the potential voltage is applied on the Y toner image formed on the photoreceptor drum 10 by a charging action of a magenta (M) scorotron charger 11, and image writing by an electrical signal corresponding to the second color signal, that is, the M image data is conducted by an M exposure optical system 12, and a magenta (M) toner image is formed on the yellow(Y) toner image by superimposition, by non-contact reversal development by an M developing device 13.

In the same process, a cyan (C) toner image corresponding to the third color signal is further formed by superimposition, by a cyan © scorotron charger 11, C exposure optical system 12 and C developing device 13, and further a black (K) toner image corresponding to the fourth color signal is successively formed by superimposition on the above toner images, by a black (K) scorotron charger 11, K exposure optical system 12 and K developing device 13. Then, a superimposed color toner image of four colors of yellow (Y), magenta (M), cyan (C) and black (K) is formed on the peripheral surface of the photoreceptor drum 10 during its single rotation, (a toner image forming means).

The image writing onto the photoreceptor layer of the photoreceptor drum 10 by the Y, M, C, K exposure optical system 12 is conducted through the transparent base body from the inside of the drum. Accordingly, image writing corresponding to the second, third and fourth color signals is conducted with completely no influence by any previously formed toner image, thereby, the electrostatic latent image having the same quality as the image corresponding to the first color signal can be formed.

By the above image forming process, a superimposed color toner image, which is a back side image, formed on the photoreceptor drum 10, serving as the first image bearing means, is collectively transferred onto the toner image receiving body 14*a,* serving as the second image bearing means, by the transferring device 14*c,* serving as the first transferring means, in the transfer area 14*b* (FIG. 3(*a*)). In this case, uniform exposure by the transfer simultaneous exposure device 12*d* provided inside the photoreceptor drum 10 may be conducted so that fine transferring can be carried out.

Toner remaining on the circumferential surface of photoreceptor drum 10 after transferring, is discharged by photoreceptor drum AC discharger 16, and after that, moved to cleaning device 19 as a first image bearing means cleaning means, cleaned by cleaning blade 19*a* formed of rubber material in contact with photoreceptor drum 10, and is collected into a waste toner container, not shown, by screw 19*b*. Further, the peripheral surface of photoreceptor drum 10 is exposed by a pre-charging uniform exposure device 12*e* using, for example, light emitting diodes, and all traces on the photoreceptor drum 10 due to previous image formation, is eliminated.

As described above, after a superimposed color toner image, which is a back side image, has been formed on the toner image receiving body 14*a,* successively, in the same manner as the above color image forming process, a superimposed color toner image which is a front side image, is formed on the photoreceptor drum 10 (FIG. 3(*b*)). In this case, image data is changed so that the front side image formed on the photoreceptor drum 10 forms a mirror image with respect to the back side image previously formed on the photoreceptor drum 10.

According to the front side image formation onto photoreceptor drum 10, recording sheet P, serving as transfer sheet, is sent from sheet feed cassette 15, which is a transfer sheet accommodation means, by feeding roller 15*a,* conveyed to timing roller 15*b,* which is a transfer sheet feeding means, and recording sheet P is fed in timed relationship with the color toner image of the front side image borne on photoreceptor drum 10, and the color toner image of the back side image which is borne on toner image receiving body 14*a,* by the drive of timing roller 15*b,* and is sent to transfer area 14*b*. In this case, recording sheet P is paper-charged to the same polarity as the toner by paper charger 150 which is provided on the front surface side of fed recording sheet P, and onto which DC voltage with the same polarity as the toner (in the present example, a negative polarity) is applied, and is drawn to toner image receiving body 14*a* and advanced to transfer area 14*b*. By paper charging the recording sheet to the same polarity as the toner, recording sheet P and the toner image on toner image receiving body 14*a* or the toner image on photoreceptor drum 10, are prevented from being attracted to each other, and thereby, the toner image is repelled from being disturbed. Paper charger 150 is separated from toner image receiving body 14*a* simultaneously with the passage of recording sheet P so that contacting of paper charger 150 is canceled.

Paper charger 150 is canceled contacting from toner image receiving body 14*a* to be separated from recording paper P immediately before the passage of the trailing end of recording paper P or simultaneously during the passage thereof. Application of voltage onto paper charger 150 is conducted only when recording sheet P is fed. Simultaneously with the separation with recording paper P, voltage applied to paper charger 150 is cut off.

In addition, it is also possible to use, as a transfer sheet charging means, conductive rollers, semi-conductive film member or a blade member each capable of contacting and canceling contacting toner image receiving body 14*a,* to which direct current voltage with the same polarity as the toner is applied.

In transfer area 14*b,* the front side image on photoreceptor drum 10 is completely transferred onto the front side of recording sheet P by transferring device 14*c* as the first transferring means onto which voltage with polarity reversal to the toner (in the present example, a positive polarity) is applied. At this time, the back side image on toner image receiving body 14*a* is not transferred onto recording sheet P, but exists only on toner image receiving body 14*a*. Uniform exposure may be conducted by transfer simultaneous exposure device 12*d,* which is provided inside photoreceptor drum 10, opposite to the transfer area 14*b,* using, for example, light emitting diodes so that transferring can be finely conducted in the case of transferring by transfer device 14*c*.

Recording sheet P, onto the front side of which the color toner image has been transferred, is conveyed to back side transferring device 14*g* as the second transferring means onto which voltage with a polarity reversal to the toner (in the present example, a positive polarity) is applied, and the back side image on the circumferential surface of toner image receiving body 14*a* is completely transferred onto the back side of recording sheet P by back side transferring device 14*g* (FIG. 3(*c*)).

Recording sheet P is separated from toner image receiving body 14*a,* due to the curvature of drive roller 14*d* which drives toner image receiving body 14*a* and also due to the discharging effect of paper separation AC discharger 14*h* provided facing drive roller 14*d* at the end of toner image receiving body 14*a* as necessary as a transfer sheet. Then, recording sheet P is conveyed to fixing device 17, serving as a fixing means through conveyance section 160 utilizing separation claw 161 and spurred wheel 162 described later. Here, in order to realize favorable separation, paper separation AC discharger 14*h* to which voltage is applied is positioned facing drive roller 14*d* grounded.

Recording sheet P, whereon color toner images are formed on both sides, and is conveyed to fixing device 17 functioning as a fixing means constituted of two paired rollers in which a heater is provided inside both rollers. Due to that heat and pressure are applied at nip portion T formed with fixing roller 17*a,* as a fixing means, located upper side for fixing the toner images of the surface image (images on the upper side) and pressure roller 17*b,* as a fixing member, located lower side for fixing the toner images of the back surface image (images on the lower side), toner images adhered on the front surface and the back side surface on recording paper P are fixed. Recording paper P, on which images have been recorded on both sides, is reversed by passing between fixing and discharging rollers 17*c,* conveyance rollers 18*a* and 18*b* and paper-discharging rollers 18. The reversed recording paper P is conveyed and discharged onto above the apparatus while the toner images on the front surface face downward. In addition, it is also allowed to provide a switching member (not illustrated) at the trailing end of fixing and discharging rollers 17*c* on the outlet port of fixing device 17, as shown by a dot-dash line in FIG. 1, so that aforesaid recording paper P is caused to be discharged onto the tray outside the apparatus while the toner images on the front side face upward.

Toner remaining on the circumference of toner image receiving body 14*a* after transferring is cleaned by cleaning device 140 for the toner image receiving body having a cleaning blade 141 of toner image receiving body, which is provided facing driven rollers 14*e* so that toner image receiving body 14*a* is sandwiched by cleaning device 140 for the toner image receiving body and driven rollers 14*e,* capable of contacting and canceling contacting toner image receiving body 14*a* with fulcrum 142 as a pivot.

Toner remaining on the circumference of photoreceptor drum 10 after transferring is discharged by photoreceptor drum AC discharger 16, and then, the remaining toner is removed from cleaning device 19. By means of uniform exposure device 12*e,* all traces on photoreceptor drum 10 due to prior image formation are cleared, and then, is ready for the next image forming cycle.

By the use of the above-mentioned method, superposed color toner images are collectively formed. Accordingly, color shift on the color image, toner scattering and abrasion on are less likely to occur. Accordingly, favorable double-sided color image can be formed in which image deterioration is negligible.

Figure 4:
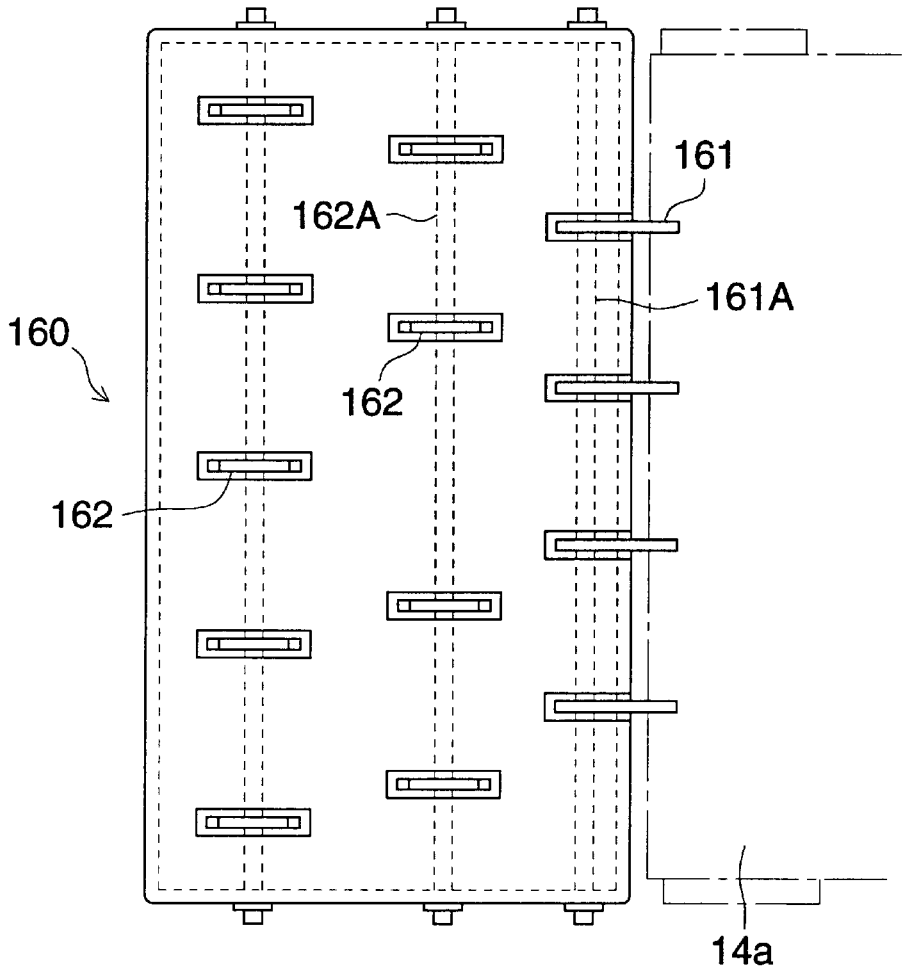
FIGS. 4(*a*) and 4(*b*) are respectively a plan and a cross sectional view showing a basic constitution of the conveyance section provided in the image forming apparatus.
Figure 4:
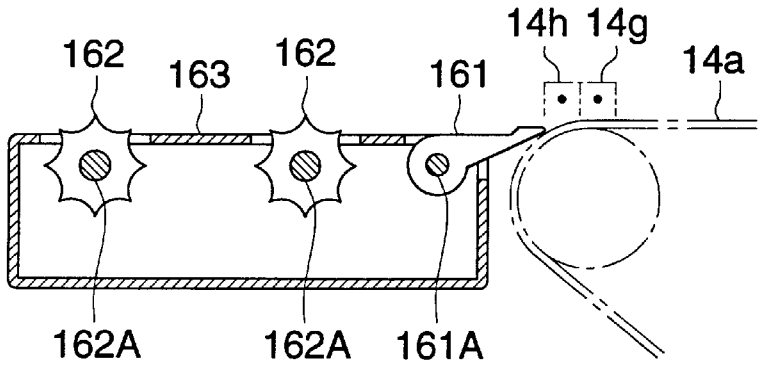

FIGS. 4(*a*) and 4(*b*) exhibit a basic structure of the above-mentioned conveyance section 160. At the end of the upstream of the conveyance path, plural of the above-mentioned separation claws 161 are fixed on supporting shaft 161A with a prescribed interval on toner image receiving body 14*a*. The end portion of each separation claw 161 is close to the circumference of the curvature portion formed by drive roller 14*d* of the above-mentioned toner image receiving body 14*a,* which face each other.

Downstream of the conveyance path from the above-mentioned separation claws 161, as spurred wheels, each of the above-mentioned spurred wheels 162 is supported rotatably on respective supporting shaft 162A at a prescribed interval. Both of the end of each claw members 161 and the circumference of each of the spurred wheels 162 are positioned slightly below compared with the extension plane of the conveyance face of toner image receiving body 14*a*.

In addition, the above-mentioned conveyance section 160 is provided with conveyance guiding member 163 as a means for retaining transferring which supports the back side of recording paper P at a certain interval. On the upper surface thereof, each of the above-mentioned separation claws 161 and each spurred wheel protrude.

When at least the end of recording paper P onto which toner images are transferred on both surfaces is separated from the circumference of toner image receiving body 14*a,* aforesaid recording paper P is brought into contact with the upper side of separation claw 161 and peeled off successively.

Recording paper P conveyed to conveyance section 160 as described above is supported by the outer circumference of the above-mentioned spurred wheels 162. Due to driven rotation of spurred wheels 162 following movement of recording paper P, the toner image transferred is conveyed to fixing device 17 without damaging it.

When each of the above-mentioned spurred wheel 162 is made of a metal material, it is preferable to ground it through a high resistance body in order to prevent charging.

Embodiment 1

Each embodiment relating to the separation claw will be explained referring to FIGS. 5(*a*) through 7(*b*). In all embodiments of the present invention, the separation claw can be withdrawn from the curvature section conducting separation.

Figure 5:
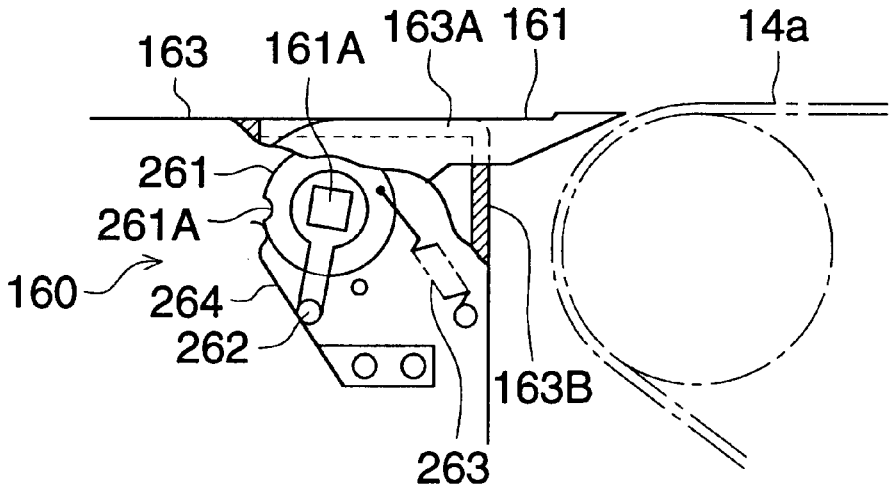
FIGS. 5(*a*) and 5(*b*) show explanatory drawings of the first embodiment of the claw member withdrawing means.
Figure 5:
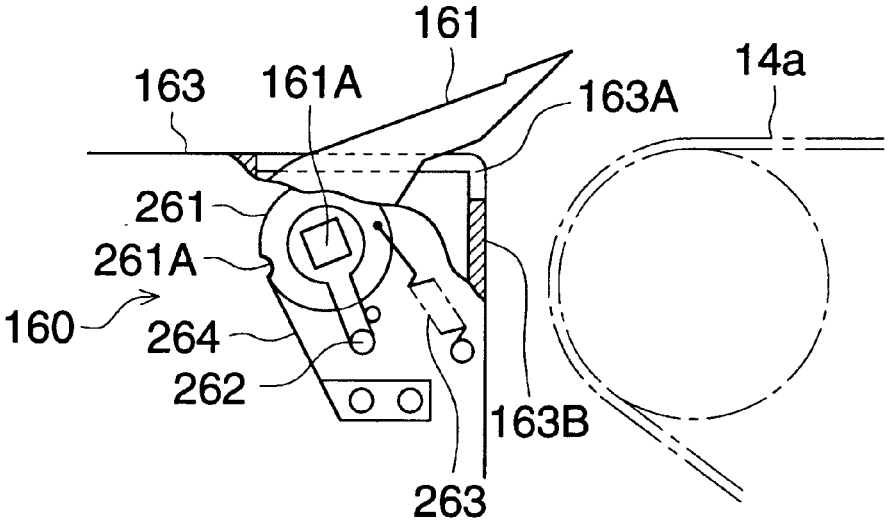

FIGS. 5(*a*) and 5(*b*) show the first embodiment of the claw member withdrawing means. Each of the above-mentioned separation claws 161 is fixed in the same direction on the shaft of square pillar shaped supporting shaft 161A provided on both sides of conveyance section 160. The end of each claw protrudes from slit-shaped aperture portion 163A on conveyance guiding member 163, facing the curvature section of toner image receiving body 14*a*.

The above-mentioned supporting shaft 161A is integral with disc members 261 at each end protruded from the outer side surfaces of the conveyance section, in which the phase of notch portion 261A of disc members 261 is common to each other. On disc member 261 in front of the apparatus, lever 262 for operating is fixed.

Each of the above-mentioned disc members 261 is biased to rotate clockwise by means of tensioning spring 263. Accordingly, each of the above-mentioned separation claws 161 is brought into contact with protrusion section 163B in conveyance guiding member 163 provided as a means for regulating the position of the leading end of the claw member as shown in FIG. 5(*a*). As a result, each of the above-mentioned disc members 261 is correctly positioned at the prescribed position in relation to the curvature section of toner image receiving body 14*a*.

When the above-mentioned notch portion 261A is engaged with fixed elastic member 264 in conveyance section 160 according to the rotation of the lever 262 in the counterclockwise direction, each of the above-mentioned disc members 261 is retained in a status as shown in FIG. 5(*b*). The end portion of each of the above-mentioned separation claws 161 is caused to be moved to a withdrawn position noticeably separated from the curvature section of toner image receiving body 14*a*.

Figure 6:
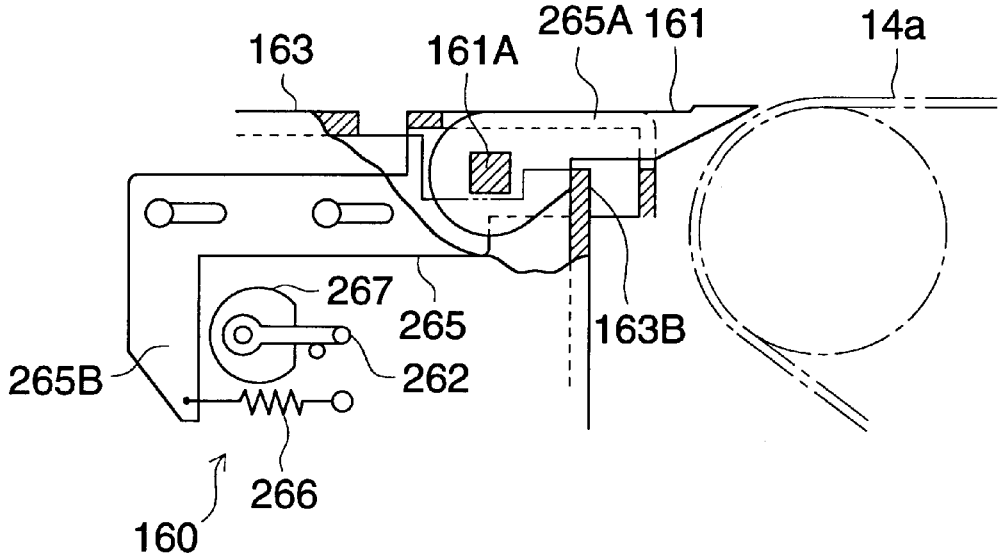
FIGS. 6(*a*) and 6(*b*) show explanatory drawings of the second embodiment of the claw member withdrawing means.
Figure 6:
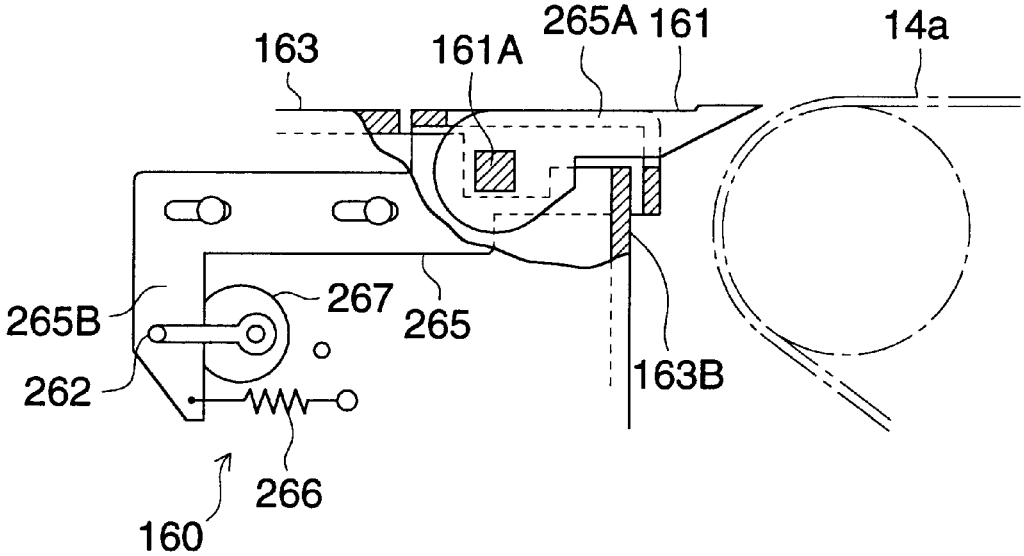

FIGS. 6(*a*) and 6(*b*) show the second embodiment of the invention. Each of the above-mentioned separation claws 161 is fixed in the same direction on the shaft of square pillar shaped supporting shaft 161A provided on both sides of sliding member 265 which is supported on conveyance section 160 and is capable of moving horizontally. The leading end of each of the separation claws 161 is protruded from slit-shaped aperture 265A whose upper surface is coincident with the upper surface of conveyance guiding member 163, and faces the curved section of toner image recording body 14*a*.

The above-mentioned sliding member 265 is biased to the right side, i.e., to the side of toner image receiving body 14*a*. Accordingly, as shown in FIG. 6(*a*), each separation claw 161 is brought into contact with protrusion section 163B of conveyance guiding member 163 provided as a means for regulating the position of the leading end of the claw member. As a result, each of the above-mentioned disc members 261 is thereby correctly positioned at the prescribed position in relation to the curvature section of toner image receiving body 14*a*.

The above-mentioned sliding member 265 contacts the circumference of eccentric cam 267 so that the side surface of protrusion portion 265B is displaced through lever 262 for operation. When the above-mentioned lever 262 is subjected to a half turn, as shown in FIG. 6(*b*), sliding member 265 is slid toward the left direction in opposition to the tension of tension spring 266 due to pressure of eccentric cam 267. Each separation claw 161 is thereby caused to be moved to a withdrawn position noticeably separated from the curvature section of toner image receiving body 14*a*.

Figure 7:
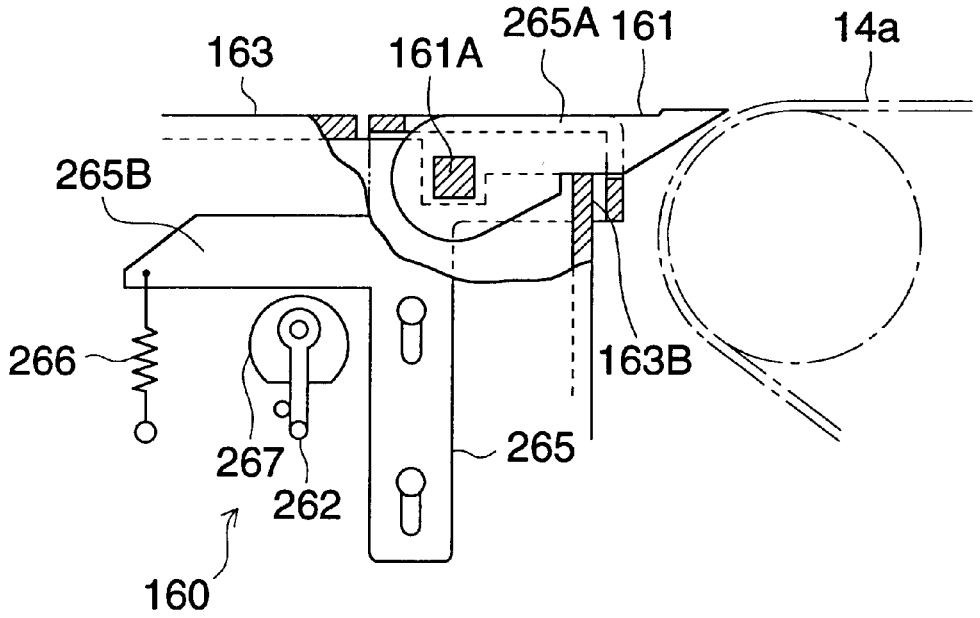
FIGS. 7(*a*) and 7(*b*) show explanatory drawings of the third embodiment of the claw member withdrawing means.
Figure 7:
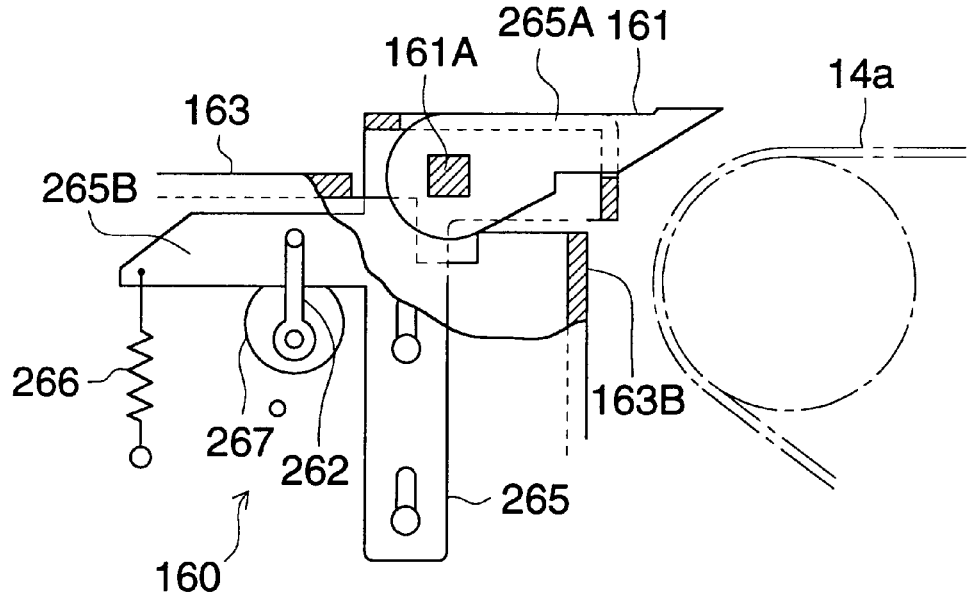

FIGS. 7(*a*) and 7(*b*) show the third embodiment of the claw member withdrawing means. Each of the above-mentioned separation claws 161 is fixed in the same direction on the shaft of square pillar shaped supporting shaft 161A provided on both sides of sliding member 265 which is supported on conveyance section 160 and is capable of moving vertically. The leading end of each of the separation claws is protruded from slit-shaped aperture 265A whose upper surface is coincident with the upper surface of conveyance guiding member 163 and faces the curved section of toner image receiving body 14*a*.

By means of tension spring 266, the above-mentioned sliding member 265 is forced downward. As a result, separation claws 161 are brought into contact with protrusion section 163B of conveyance guiding member 163, as shown in FIG. 7(*a*), as a means for regulating the position of the leading end of the claw member. Due to this, separation claws 161 are correctly set at a prescribed position in relation to the curvature portion of toner image receiving body 14*a*.

The above-mentioned sliding member 265 faces the circumference of eccentric cam 267 so that the lower surface of protrusion section 265B is dislocated through lever 262 for operation. When the above-mentioned lever 262 is subjected to a half turn, as shown in FIG. 7(*b*), sliding member 265 is slid toward the upper direction in opposition to the tension of tension spring 266 due to pressure of eccentric cam 267. Each separation claw 161 is caused to be moved to a withdrawn position noticeably separated from the curvature section of toner image receiving body 14*a*.

Embodiment 2

Each embodiment relating to the spurred wheel will be explained referring to FIGS. 8(*a*) and 8(*b*) and FIGS. 9(*a*) and 9(*b*). In all embodiments of the present invention, the spurred wheel can be withdrawn from the back side of the transfer sheet.

Figure 8:
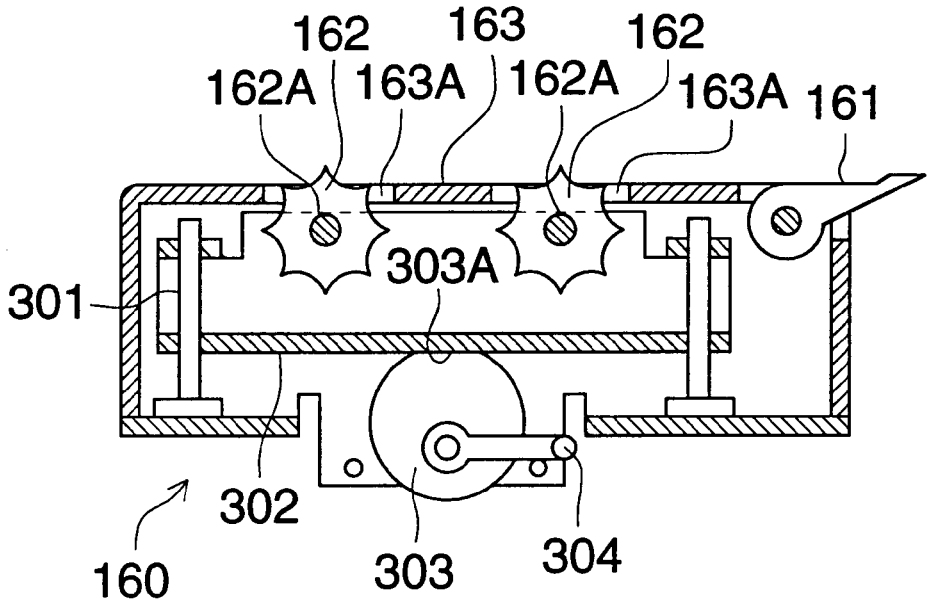
FIGS. 8(*a*) and 8(*b*) show explanatory drawings of the first embodiment of the spurred wheel withdrawing means.
Figure 8:
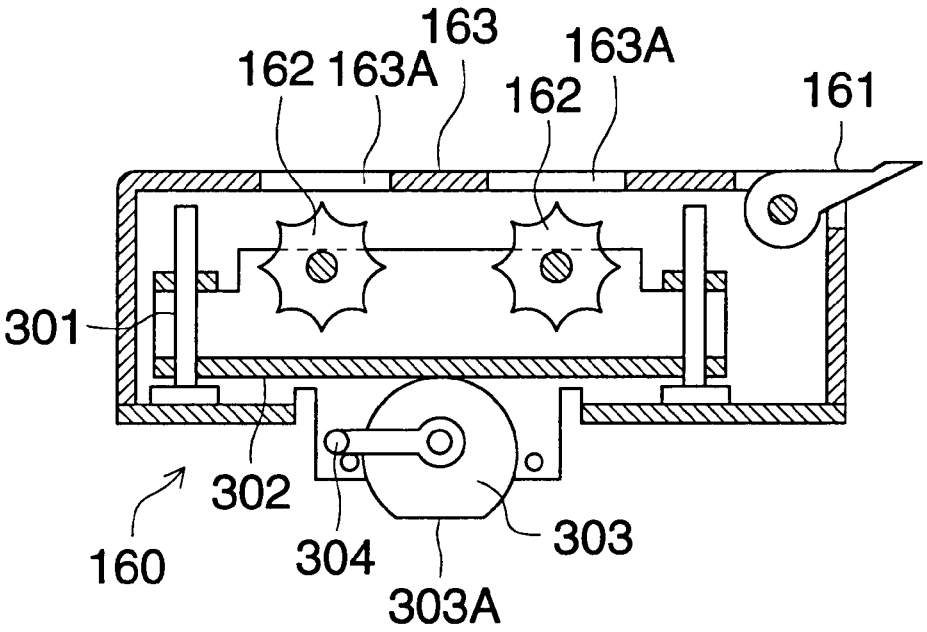

FIGS. 8(*a*) and 8(*b*) show the first embodiment of a spurred wheel withdrawing means. Each of the above-mentioned spurred wheels 162 are engaged with 4 guiding pillar 301 which stand vertically inside conveyance section 160 so that it is supported rotatably on central frame member 302 supported capable of being shifted in parallel vertically through paired supporting shafts 162A. Due to that the above-mentioned central frame member 302 is brought into contact with flat portion 303A on the outer circumference of eccentric cam 303 due to its own weight, so that the outer circumference of each spurred wheel 162 protrudes from aperture portion 163A of conveyance guiding member 163 and set at a prescribed conveyance position.

When the above-mentioned eccentric cam 303 is subjected to a half turn with lever 304 for operation in which the above-mentioned eccentric cam 303 contacting the bottom surface of the central frame member 302 is fixed on the same shaft as that of the lever 304, as shown in FIG. 8(*b*), flat portion 303A of eccentric cam 303 is dislocated downward. Central frame member 302 is shifted parallel downward due to its own weight. Each spurred wheel 162 is dropped from the prescribed conveyance position to be caused to move to the withdrawn position on the back side surface of transfer sheet, i.e., recording paper P. In such occasion, recording paper P during conveyance is received by the upper surface of the above-mentioned conveyance guiding member 163.

Figure 9:
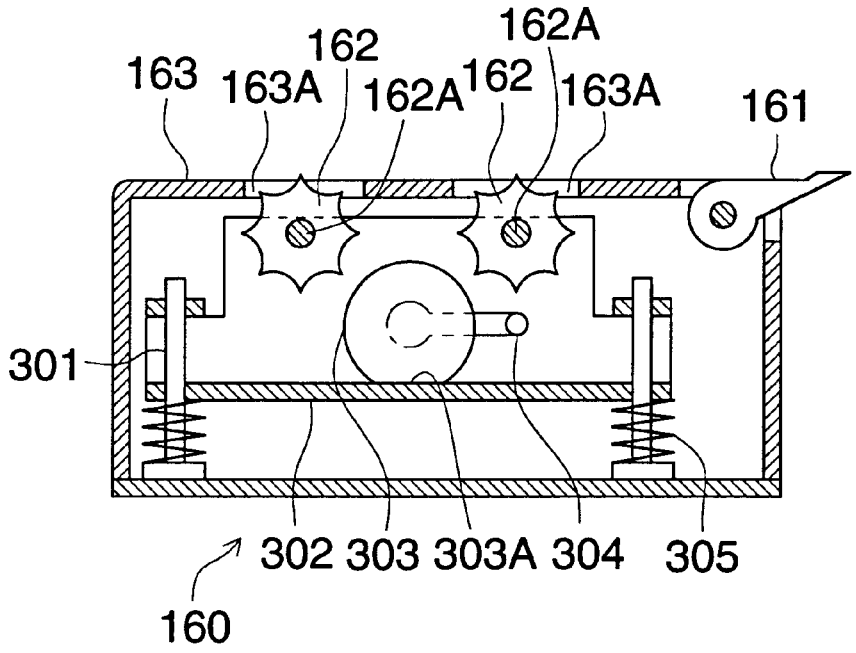
FIGS. 9(*a*) and 9(*b*) show explanatory drawings of the second embodiment of the spurred wheel withdrawing means.
Figure 9:
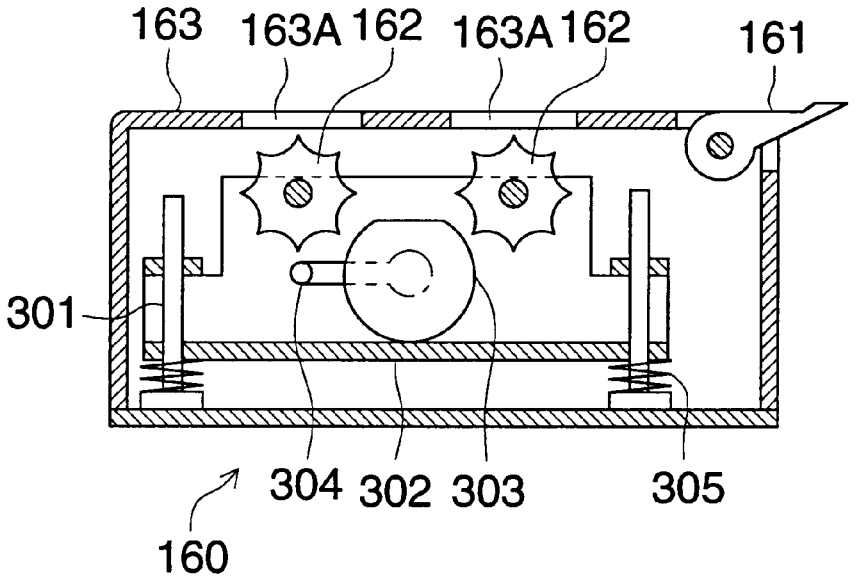

FIGS. 9(*a*) and 9(*b*) show the second embodiment of the spurred wheel withdrawing means. Each of the above-mentioned spurred wheels 162 are, in the same manner as in the first embodiment, engaged with 4 vertical guiding shafts 301 which stand vertically inside conveyance section 160 so that it is supported rotatably on central frame member 302 supported capable of being shifted in parallel vertically through paired supporting shafts 162A. Due to the fact that the above-mentioned central frame member 302 is brought into contact with flat portion 303A on the outer circumference of eccentric cam 303 due to the biasing of pressure springs 305, the outer circumference of respective spurred wheels 162 protrude from aperture portion 163A of conveyance guiding member 163 to be set at a prescribed conveyance position.

When the above-mentioned eccentric cam 303 is subjected to a half turn through lever 304 for operation in which the above-mentioned eccentric cam 303 is fixed on the same shaft as that of the lever 304, as shown in FIG. 9(*b*), flat portion 303A of eccentric cam 303 is dislocated upward. Central frame member 302 is shifted parallel downward due to the force of pressure springs 305. Each spurred wheel 162 is dropped from the prescribed conveyance position to be caused to move to the withdrawn position on the back side surface of the transfer sheet, i.e., recording paper P. In such occasion, recording paper P during conveyance is received and supported by the upper of the above-mentioned conveyance guiding member 163.

Embodiment 3

Each embodiment relating to the conveyance section will be explained referring to FIGS. 10 through 12(*b*). In all embodiments of the present invention, the conveyance guide member having the separation claw and the spurred wheel can be withdrawn to the lower side of an approximately horizontal conveyance trajectory of the transfer sheet, wherein the separation claw is not brought into contact with the curvature section.

Figure 10:
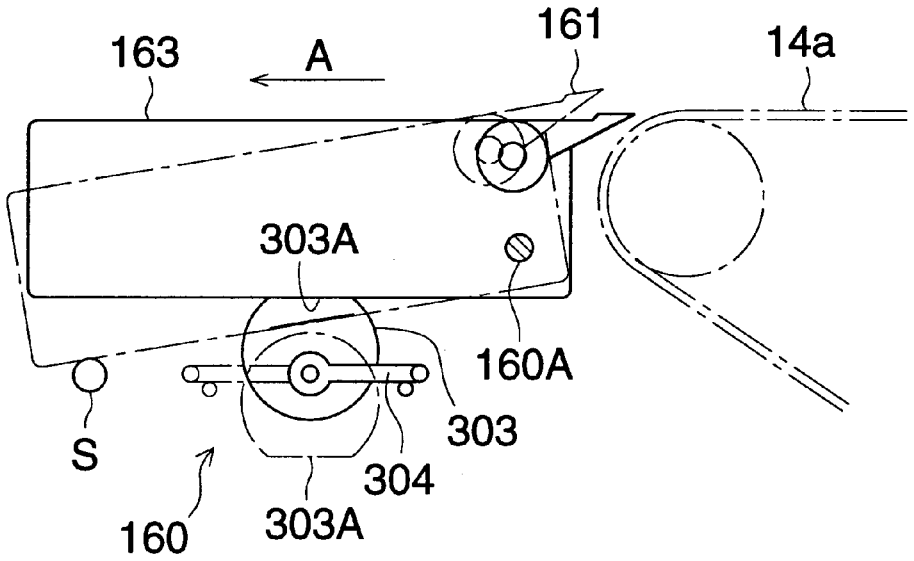
FIG. 10 shows an explanatory drawing of the first embodiment of the conveyance section withdrawing means.

FIG. 10 show the first embodiment of the conveyance withdrawing means. The above-mentioned conveyance section 160 is retained rotatably as a fulcrum of supporting shaft 160A which is inserted in parallel to vertical to the conveyance direction of recording paper P. Due to that the bottom surface of the above-mentioned conveyance section 160 is supported by flat portion 303A of eccentric cam 303 provided in the image forming apparatus main body, conveyance guiding member 163 on the upper surface is kept horizontal. The above-mentioned separation claws 161 and each spurred wheel 162 (not illustrated) are set at the prescribed position of separation and conveyance.

When the above-mentioned eccentric cam 303 is subjected to a half turn through lever 304 for operation in which the above-mentioned eccentric cam 303 is fixed on the same shaft as that of the lever 304, as shown in a dot-dash line, flat portion 303A of eccentric cam 303 is dislocated downward. As a result, conveyance section 160 is rotated counterclockwise with the above-mentioned supporting shaft 160A as a fulcrum due to its own weight. Aforesaid conveyance section 160 is brought into contact with stopper S to be inclined to the conveyance direction (arrow A) of the transfer sheet. Each separation claw 161 is separated from the curvature section of toner image receiving body 14*a* to the safe withdrawn position.

Figure 11:
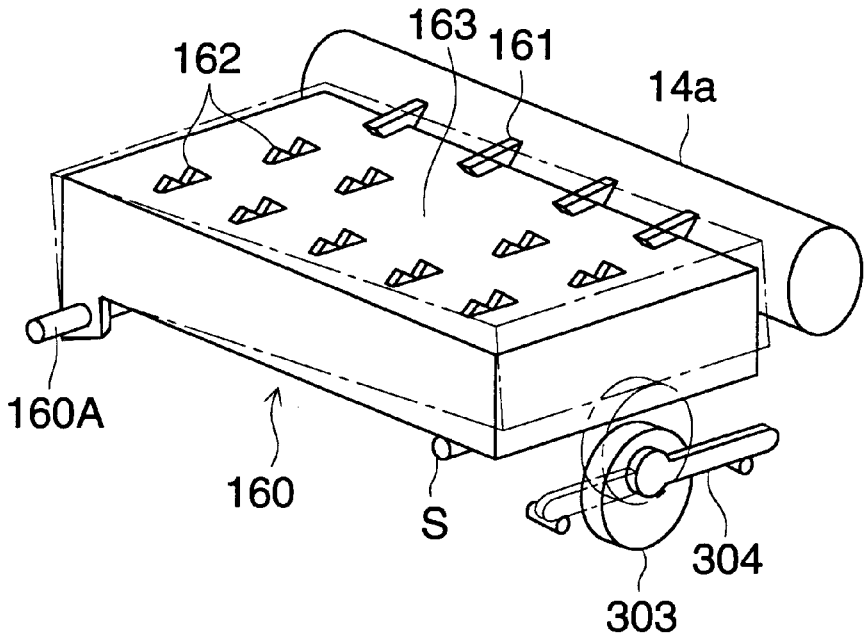
FIG. 11 shows an explanatory drawing of the second embodiment of the conveyance section withdrawing means.

FIG. 11 shows the second embodiment of the conveyance section withdrawing means. The above-mentioned conveyance section 160 is retained rotatably with supporting shaft 160A inserted parallelly to the conveyance direction of recording paper P, in which conveyance guiding member 163 on the upper side is kept horizontal due to that the bottom surface is supported by stopper S. The above-mentioned separation claws 161 and each spurred wheel 162 are set at the prescribed position of separation and conveyance.

When the above-mentioned eccentric cam 303 is subjected to a half turn through lever 304 for operation in which the above-mentioned eccentric cam 303 is fixed on the same shaft as that of lever 304, as shown in a dot-dash line, circumference of eccentric cam 303 is dislocated downward. As a result, conveyance section 160 is rotated counterclockwise with the above-mentioned supporting shaft 160A as a fulcrum resisting its own weight to be inclined to the direction perpendicular to the conveyance direction of the transfer sheet. Aforesaid separation claw 161 is separated from the curvature section of toner image receiving body 14*a* to the withdrawn position.

Figure 12:
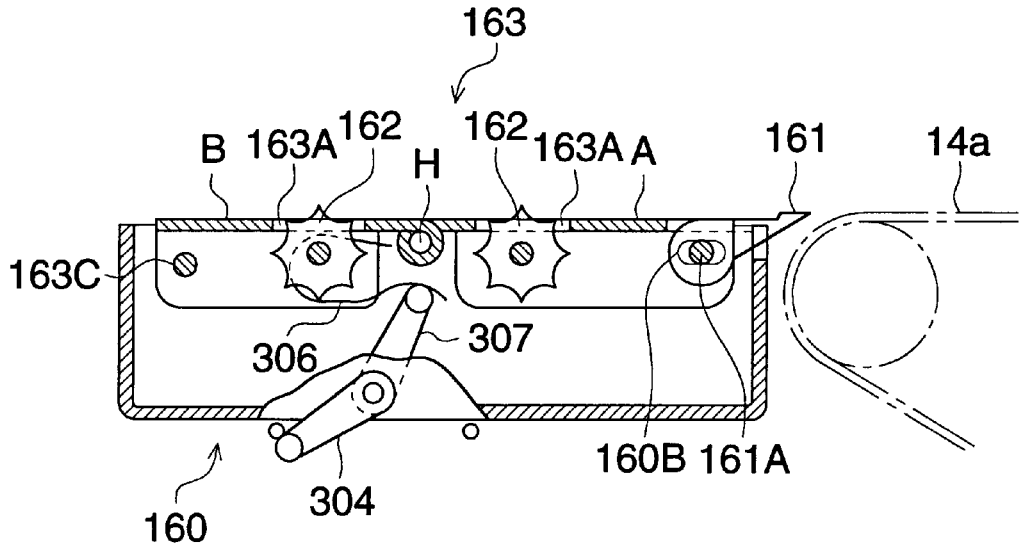
FIGS. 12(*a*) and 12(*b*) show explanatory drawings of the third embodiment of the conveyance section withdrawing means.
Figure 12:
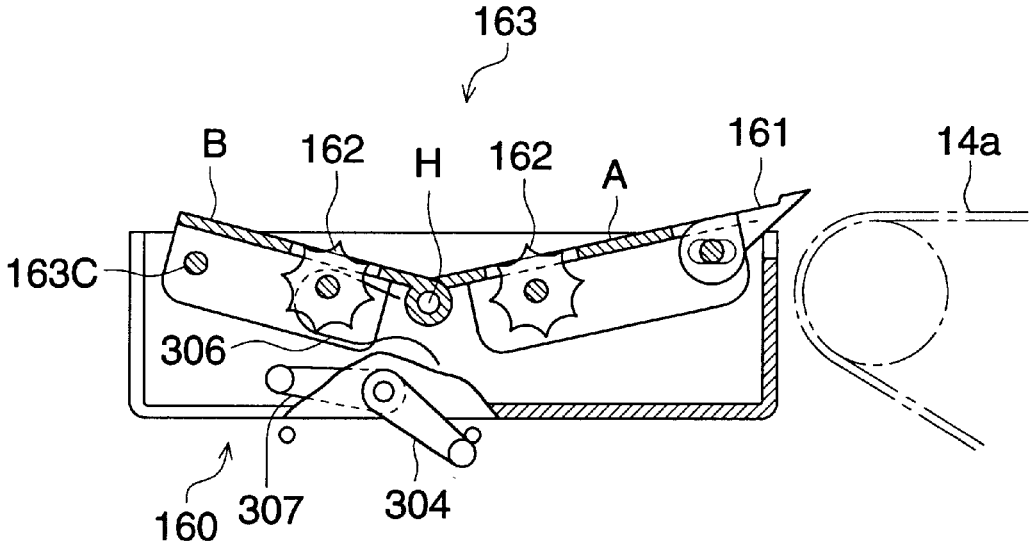

FIGS. 12(*a*) and 12(*b*) show the third embodiment of the conveyance section withdrawing means. Conveyance guiding member 163 provided by the above-mentioned conveyance section 160 is composed of two members in which a body different from the conveyance section main body is united. Separation claws 161 and spurred wheels 162 are supported on member A on the upstream of conveyance path and only spurred wheels 162 are supported on member B on downstream of the conveyance path fixedly or rotatably.

The above-mentioned members A and B are united by the combination shaft H in the form of hinge. Member B on the downstream side is supported rotatably by conveyance section 160 main body by the use of supporting shaft 163C. On the other hand, in member A on the upstream side, the end of the shaft of supporting shaft 161A which fixes separation claw 161 is engaged with long hole 160B provided by conveyance section 160 main body to be supported horizontally slidably. Rotation range of each of the above-mentioned members-is regulated at combination shaft H so that the upper surface of conveyance guiding member 163 formed by each member does not form a protrusion surface, exceeding the flat surface.

Member B on the downstream side is provided with plate-shaped elastic member 306. As shown in FIG. 12(*a*) in which pressure member 307 is brought into contact with the above-mentioned elastic member 306, due to reaction force of elastic member 306, combination shaft H is pressed upward so that member B on the downstream is biased counterclockwise or clockwise with supporting shaft 161A as a fulcrum. As a result, a required conveyance guiding member 163 is formed in which the upper surface is identical to that of member A. The above-mentioned separation claws 161 and each spurred wheel 162 are set at the prescribed position of separation and conveyance.

When the above-mentioned pressure member 307 is rotated counterclockwise through lever 304 for operation in which the above-mentioned pressure member 307 is fixed on the identical shaft to that of the lever 304, as shown in FIG. 12(*b*), pressure contact of pressure member 307 on the above-mentioned elastic member 306 is canceled so that the above-mentioned combination shaft H moves downward due to the own weight of the members A and B. As a result, conveyance guiding member 163 is folded to form a convex. Separation claws 161 is separated from the curvature portion of toner image receiving body 14*a*. Each spurred wheel 162 is dropped compared with the conveyance position of the transfer sheet to be moved to the withdrawing position.

Embodiment 4

Each embodiment relating to the conveyance guiding member will be explained referring to FIGS. 13(*a*) and 13(*b*) and 14(*a*) and 14(*b*). The present embodiment enables the withdrawing of the conveyance guiding member only in the status that the separation claws withdraws.

Figure 13:
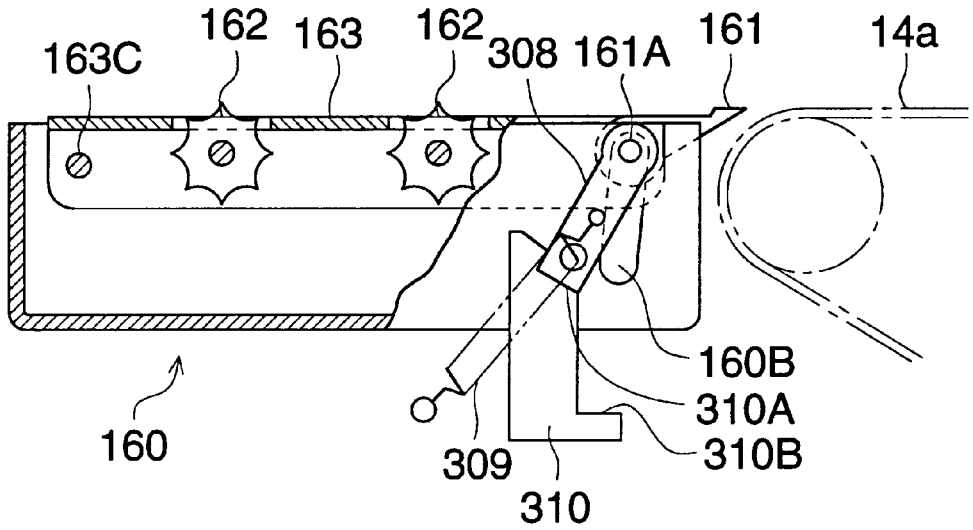
FIGS. 13(*a*) and 13(*b*) show explanatory drawings of the first embodiment of the means for prohibiting withdrawing of the conveyance section.
Figure 13:
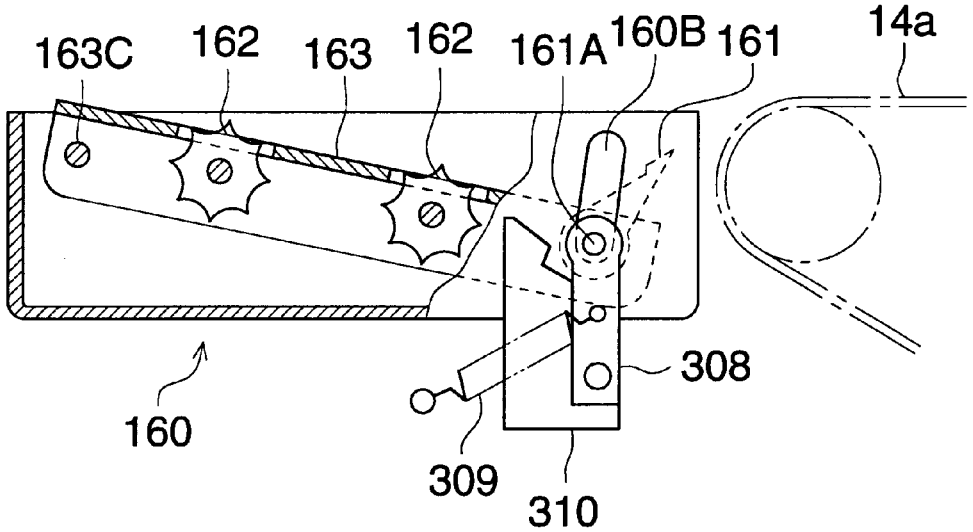

FIGS. 13(*a*) and 13(*b*) show the first embodiment of the conveyance section withdrawing prohibiting means. Conveyance guiding member 163 provided by the above-mentioned conveyance section 160 is a member different from conveyance section main body 160. Aforesaid conveyance guiding member 163 is supported rotatably by an aperture portion located on the upper portion of conveyance section 160 through supporting shaft 163C. Each of the above-mentioned separation claws 161 is mounted rotatably while being connected each other, and each of the above-mentioned spurred wheel 162 is respectively mounted rotatably.

The above-mentioned separation claw 161 is integral with engaging claw 308 by means of its supporting shaft 161A. By engaging the above-mentioned engaging claw 308 with upper step portion 310A in engaging member 310 provided by the image forming apparatus main body against the biasing of tension spring 309, as shown in FIG. 13(*a*), the above-mentioned guiding member 163 is retained horizontally. Each separation claw 161 and each spurred wheel 162 are respectively set at the separation position and the conveyance position. At aforesaid set position, due to engagement of the above-mentioned engaging claw 308 and engaging member 310, movement downward, i.e., withdrawal of conveyance guiding member 163 is prohibited.

When the above-mentioned engaging claw 308 is rotated counterclockwise so that engagement with engaging member 310 is canceled, separation claw 161 is rotated counterclockwise. Due to biasing of tension spring 309, as shown in FIG. 13(*b*), engaging claw 308 is engaged with lower step portion 310B of the above-mentioned engaging member 310. As a result, the withdrawing prohibiting means of conveyance guiding member 163 is canceled. After each separation claw 161 is separated from the curvature portion of toner image receiving body 14*a,* aforesaid each separation claw is caused to be moved to the withdrawing position together with spurred wheel 162 located below.

Figure 14:
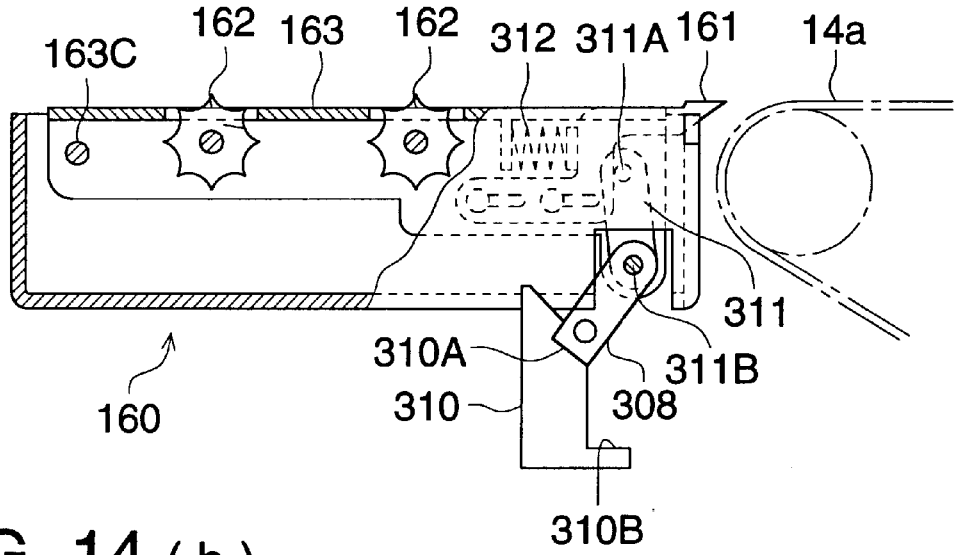
FIGS. 14(*a*) and 14(*b*) show explanatory drawings of the second embodiment of the means for prohibiting withdrawing of the conveyance section.
Figure 14:
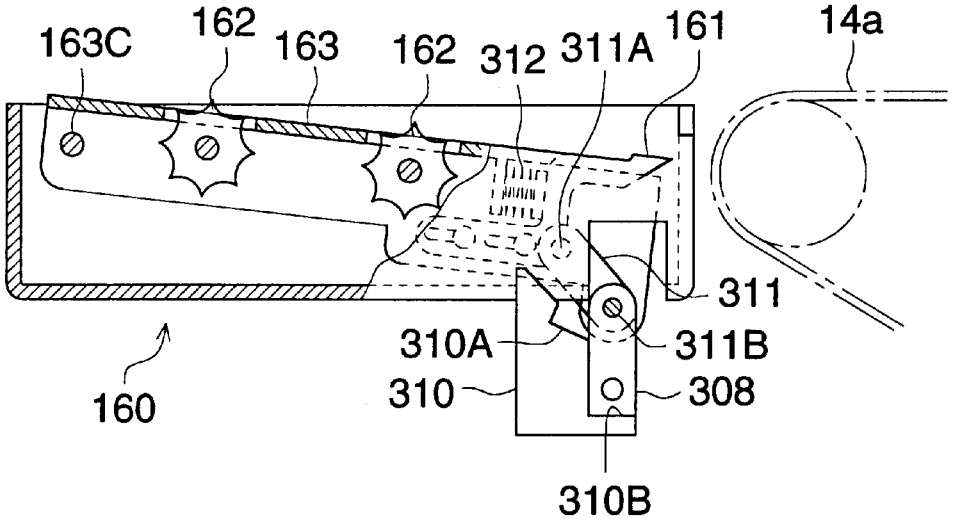

FIGS. 14(*a*) and 14(*b*) show the second embodiment of the conveyance section withdrawing prohibiting means. Conveyance guiding member 163 provided by the above-mentioned conveyance section 160 is a member separate from conveyance section 160 main body. Aforesaid conveyance guiding member 163 is supported rotatably at the aperture portion of upstream side of the conveyance section through supporting shaft 163C. Each of the above-mentioned separation claws 161 is mounted rotatably while being connected each other, and each of the above-mentioned spurred wheels 162 is respectively mounted rotatably.

The above-mentioned conveyance guiding member 163 is provided with pressure lever 311 having pressure pin 311A which is brought into contact with separation claw 161 and engaging claw which is integral by means of its supporting shaft 311B. Due to biasing of pressure spring 312, separation claw 161 is slid to the right direction so that the above-mentioned pressure pin 311A is pressed. By engaging engaging claw 308 with upper step 310A of engaging member 310 provided in the image forming apparatus main body, as shown in FIG. 14(*a*), the above-mentioned conveyance guiding member 163 is retained horizontally. Each separation claw 161 and each spurred wheel 162 are respectively set at the separation position and the conveyance position. At aforesaid set position, due to engagement of the above-mentioned engaging claw 308 and engaging member 310, movement downward, i.e., retreatment of conveyance guiding member 163 is prohibited.

When the above-mentioned engaging claw 308 is rotated counterclockwise so that engagement with engaging member 310 is canceled, the above-mentioned pressure lever 311 is rotated counterclockwise and separation claw 161 moves leftward in opposition to pressure spring 312. As shown in FIG. 14(*b*), engaging claw 308 is engaged with lower step portion 310B of the above-mentioned engaging member 310 so that engaging status can be maintained by means of reaction of the above-mentioned pressure spring 312. As a result, the withdrawing prohibiting means of conveyance guiding member 163 is canceled. After each separation claw 161 is separated from the curvature portion of toner image receiving body 14*a,* the conveyance guiding member 163 is moved to the withdrawing position located below together with spurred wheel 162.

Owing to the present invention, the separation claws provided on the conveyance section easily move horizontally or upward from the prescribed separation position to be withdrawn from the transfer body. In addition, owing to the present invention, the separation claw is correctly returned to the initial separation position at which the separation claw separates a recording sheet. Further, owing to the present invention, the spurred wheel provided in the conveyance section also moves downward from the prescribed conveyance position. With preventing drop the transfer sheet, aforesaid spurred wheel can be retreated from the conveyance surface.

Owing to the present invention, the separation claw and the spurred wheel are integrally caused to be simultaneously moved to the withdrawn position from the respective set position at which the separation claw separates a recording sheet and the spurred wheel conveys the recording sheet. In addition, owing to the present invention, the separation claw and the spurred wheel can be integrally withdrawn below the conveyance trajectory of the recording sheet.

As a result, even when a problem has occurred in the conveyance of the transfer sheet, jamming can be treated by easily removing the transfer sheet without damaging the separation claws and the spurred wheels.

Figure 15:
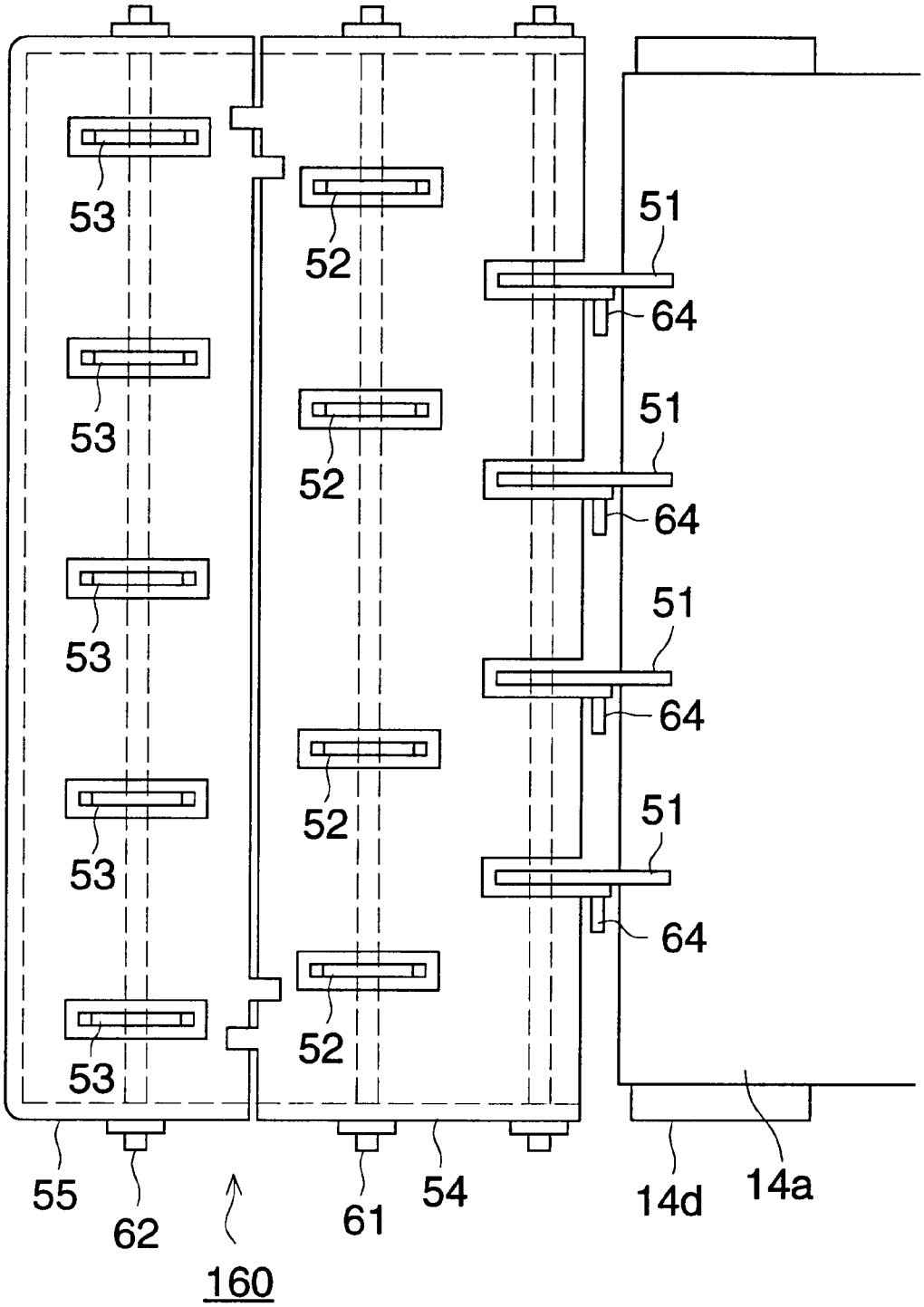
FIG. 15 shows a plan view of a conveyance section in an image forming apparatus of the other embodiment.

Next, the main portion of another embodiment will be explained referring to FIG. 15 and FIGS. 16(*a*) and 16(*b*). FIG. 15 shows a plan view of conveyance section 160. FIGS. 16(*a*) and 16(*b*) show a side view of conveyance section 160.

Due to discharging and separating operation of AC corona discharger 14*h,* curvature separation operation of driving roller 14*d* and separation operation of separation claws 51, transfer sheet P is separated from toner image receiving body 14*a.* Then, aforesaid transfer sheet is guided by spurred wheels 52 and 53 to be fed to fixing device 17. Multiple protrusions are formed on the circumference of the spurred wheels in such a manner as to minimize the area which contacts un-fixed toner images as much as possible. Four to five rotatable spurred wheels 52 and 53 are provided in two rows in the lateral direction of the transfer sheet. Spurred wheels 52 on the upstream side of the conveyance path of transfer sheet P and separation claws 51 are mounted on supporting member 54. Spurred wheels 53 on the downstream of conveyance path for transfer sheet P are mounted on supporting member 55. Supporting members 54 and 55 are constituted as separate members. By means of shaft 56, they are connected rotatably. Numeral 57 is an operation member which rotates supporting member 54. Pin 61 provided on aforesaid operation member is engaged in hole 59 provided on supporting member 54. Similarly, pin 62 mounted on operation member 58 is engaged in hole 60. By shifting operation member 57 downward, supporting member 54 rotates on shaft 56. Due to this, as shown in FIG. 16(*b*), a void space on the toner image receiving body in the vicinity of the transfer sheet conveyance path is formed. In addition, by shifting operation member 58 downward so that supporting member 55 is rotated, space on the fixing device in the vicinity of the transfer sheet conveyance path is formed. Further, due to rotation of supporting member 54, separation claws 51 move downward. Separation claws 51 touch stopper 64 due to the force of spring 63, at its operation position conducting separation, which is a stopping member. Aforesaid separation claws are positioned at the positions where the transfer sheet is separated. When aforesaid separation claws moves downward, shoulder portion 65 integral with the separation claws is pushed by stopper 64 so that aforesaid shoulder portion 65 rotates counterclockwise. As further shown in FIG. 16(*b*), aforesaid shoulder portion 65 separates from toner image receiving body 14*a* so that it moves to the stand-by position.

As explained above, by operating either of operation member 57 or 58, the respective half portion of conveyance section 160 on the toner image receiving body side or on the fixing device side is dropped so that jammed transfer sheets can be easily removed. It is a common practice to display where jamming of the transfer sheet occurred. According to jam display, either operation member 57 or 58 is operated.

The present invention is not limited to the above-mentioned embodiments. Various variations can be performed. For example, in the above-mentioned embodiment, it was constituted that the portion on the toner image receiving body side functions differently from the portion on the fixing device side. In addition, it is also allowed that, by providing conveyance section 160 integrally, either of the left side or the right side can be selectively dropped.

When jamming of transfer sheet occurs in the conveyance section having separation claws for separating the transfer sheet from the toner image receiving body and spurred wheels which guide the transfer sheet which carries un-fixed toner images on the side of toner image carrying surface, it is arranged that the above-mentioned conveyance section is retreated by an operation which is conducted based on where jamming occurrence. In addition, damage to the spurred wheels and separation claws when clearing jamming can-be prevented.

Embodiment 1

Figure 17:
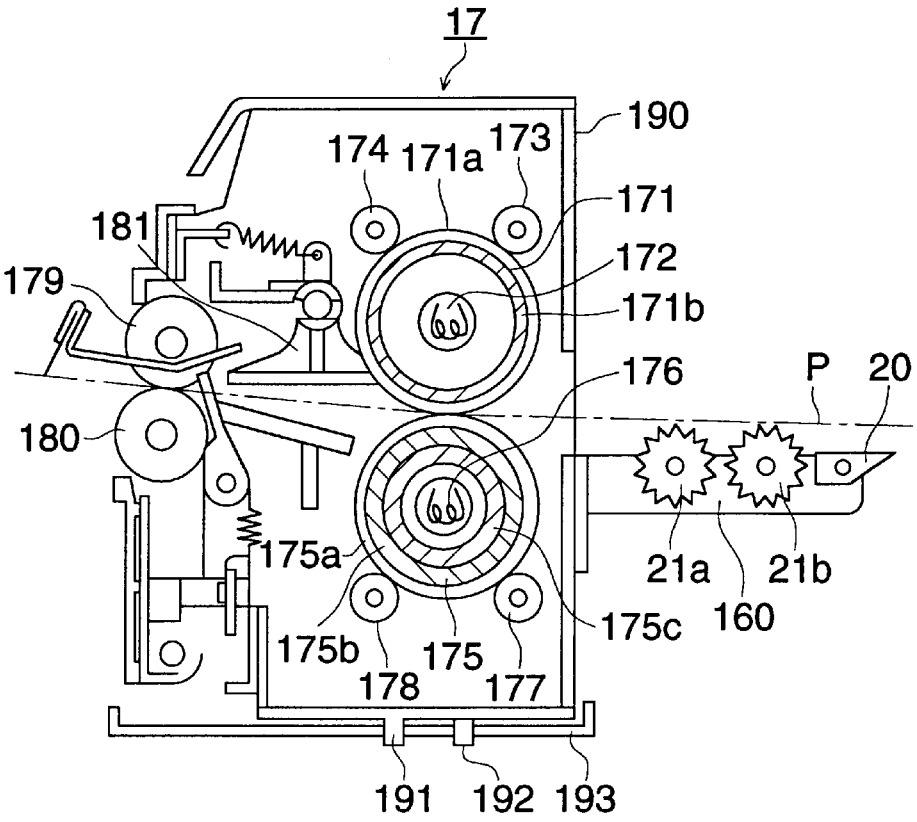
FIG. 17 shows a cross sectional view of a fixing device in Embodiment 1 related to the fixing device of the present invention.
Figure 18:
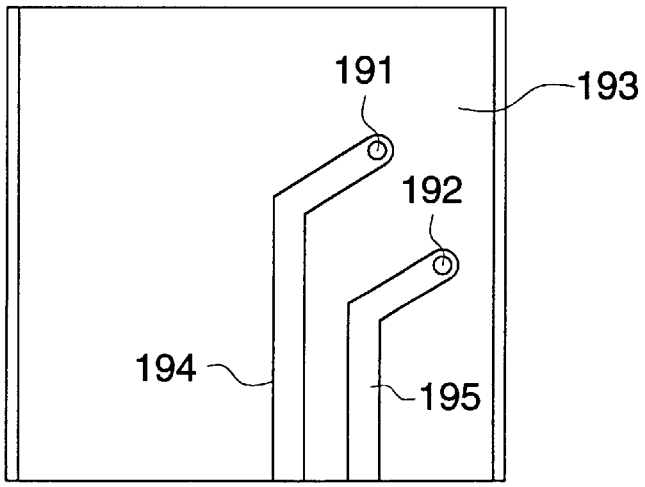
FIG. 18 is a drawing showing a fixing device detaching mechanism in the above-mentioned Embodiment 1.

Referring to FIGS. 17 and 18, embodiment 1 related to the fixing device will now be explained. FIG. 17 shows a cross sectional view of fixing device 17 of embodiment 1. FIG. 18 shows a plan view of supporting member 193 of fixing device 17.

As shown in FIG. 17, fixing device 17 is composed of upper roller 171 and lower roller 175 each of which is a heating member. Upper roller 171 is composed of fluorine resin layer 171*a* and metal substrate 171*b*. On the center thereof, lamp 172, which is a heating source, is provided. Numeral 173 represents a silicone oil-coated roller and numeral 174 represents a cleaning roller. Lower roller 175 is composed of fluorine resin surface layer 175*a*, silicone rubber layer 175*b* and metal substrate 175*c*. At the center of lower roller 175, lamp 176, which is also a heating source, is provided. Numeral 177 represents a silicone oil-coated roller and numeral 178 represents a cleaning roller.

Numerals 179 and 180 respectively represent a paper discharging roller. Numeral 181 represents a fixing and separating claw. On outer frame 190 of fixing device 17, transfer sheet separating claw 20 for ensuring separation of transfer sheet P from toner image receiving body 14*a* and conveyance section 160 which supports spurred wheels 21*a* and 21*b* which are guiding means guiding a transfer paper carrying un-fixed toner images are fixed. At the bottom of outer frame 190, guiding pins 191 and 192 are provided. Fixing device 17 is placed on supporting member 193 which is fixed on the image forming apparatus main body. Aforesaid fixing device 17 can be withdrawn to the front direction perpendicular to the page (see FIG. 17). When withdrawing fixing device 17, aforesaid fixing device 17 is guided by guiding grooves 194 and 195. At the initial stage of withdrawing, fixing device moves to the lower left, and then moves to the lower direction in FIG. 18. Due to this movement, transfer sheet separation claws 20 and spurred wheels 21*a* and 21*b* are withdrawn from the image forming apparatus together with fixing device 17 while separating it from the toner image receiving body 14*a*.

Paper jammed in the vicinity of fixing device 17 can be removed while transfer sheet separation claw 20 and spurred wheels 21*a* and 21*b* are separated from toner image receiving body 14*a*. Therefore, damage to the intermediate transfer body, the transfer sheet separation claws and the spurred wheels while removing jammed paper can be prevented. In addition, removal of the jammed paper can be conducted relatively easily.

Embodiment 2

Figure 19:
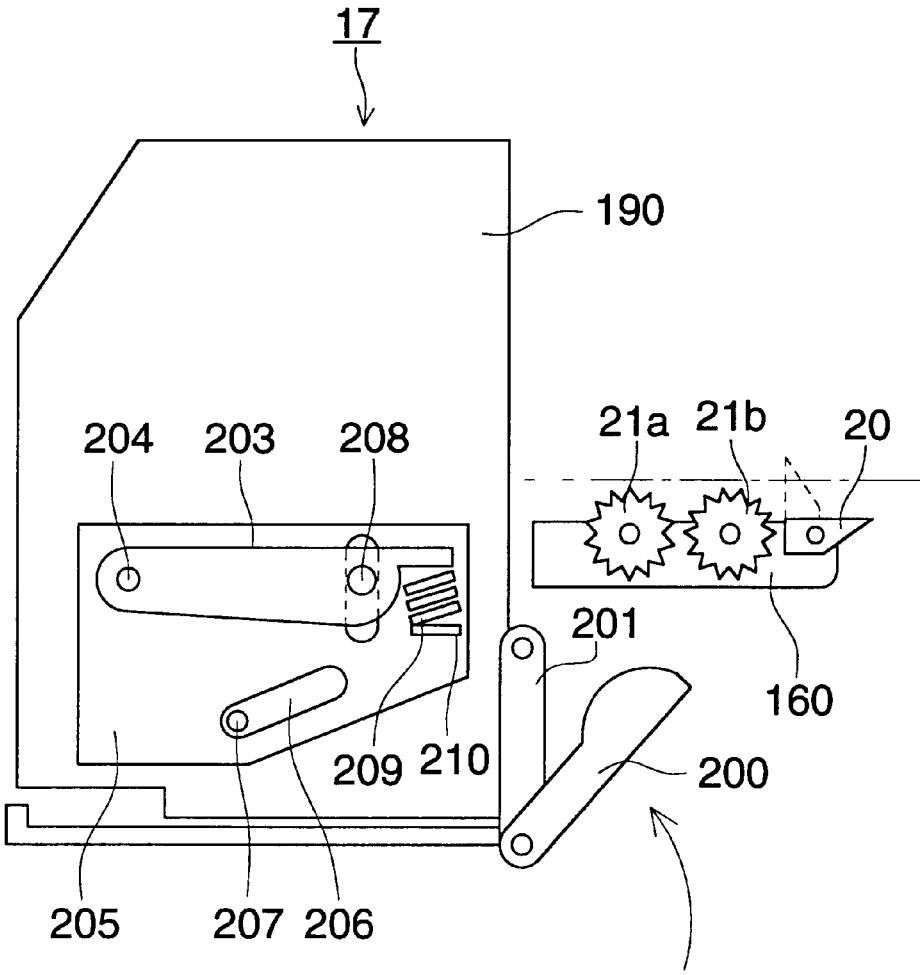
FIG. 19 is a drawing showing a fixing device detaching mechanism in Embodiment 2 related to the fixing device of the present invention.

Referring to FIG. 19, Embodiment 2 related to the fixing device will be explained. With regard to members identical to those in the above-mentioned Embodiment 1, the same numerals are assigned. The structure inside fixing device 17 including an upper roller and a lower roller is the same as that in Embodiment 1. With regard to the interior structure, FIG. 17 showing Embodiment 1 will be used.

By rotating handle 200 counterclockwise as shown by an arrow, fixing device 17 moves to the left in FIG. 19 so that aforesaid fixing device 17 is ejected from the image forming apparatus. On outer frame 190, supporting plate 205 is supported by means of shaft 204. Lower roller supporting member 203 is also supported with a shaft. Numeral 208 is a supporting shaft of lower roller 175. Lower roller supporting member 203 supports lower roller supporting shaft 208. The right end thereof is pressed upward by means of spring 209 which provides pressure for forming a nip at the fixing roller.

In FIG. 19, fixing device 17 is in its operation position. If aforesaid fixing device 17 is moved by rotating handle 200 counterclockwise, transfer sheet separation claw 20 and spurred wheels 21*a* and 21*b* also integrally move. Numeral 207 is a guiding pin fixed on the image forming apparatus main body. Supporting plate 205 rotates clockwise by means of inclined groove 206 when fixing device 17 moves to the left. Since supporting pin 210 of spring 209 which pushes lower roller supporting member 203 moves downward, lower roller 175 is released from pressure contact on upper roller 171. During release from pressure contact by lower roller 175, lamp 176, silicone oil coating roller 177 and cleaning roller 178 integrally move with lower roller 175.

When fixing device 17 is retreated from its operation position as described above, transfer sheet separation claws 20 and spurred wheels 21*a* and 21*b* also integrally retreat. As a result, pressure contact between the upper roller and the lower roller is released so that it becomes easy to remove jammed paper inside fixing device 17. Further, in the present Embodiment, it is so structured that, when jamming occurs, transfer sheet separation claw 20 automatically retreats to the position shown by a dotted line. Namely, a solenoid (not illustrated) operates by means of a jamming signal from a paper jamming detecting device (not illustrated) which detects paper jamming and which also generates a jamming signal. Due to this, transfer sheet separation claws 20 are moved to the dotted line position. Accordingly, the fixing device is withdrawn under the condition that transfer sheet separation claws 20 move to the dotted line position.

Embodiment 3

Figure 20:
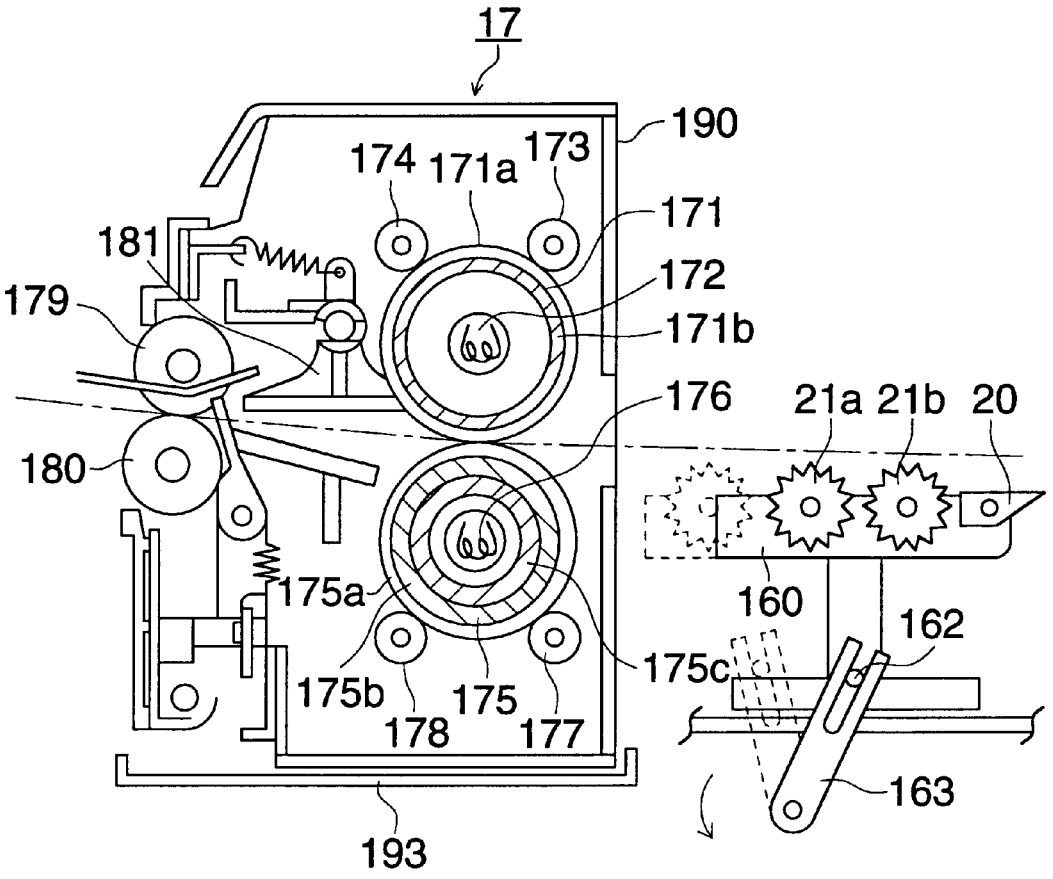
FIG. 20 is a cross sectional view showing a fixing device in Embodiment 3 related to the fixing device of the present invention.
Figure 21:
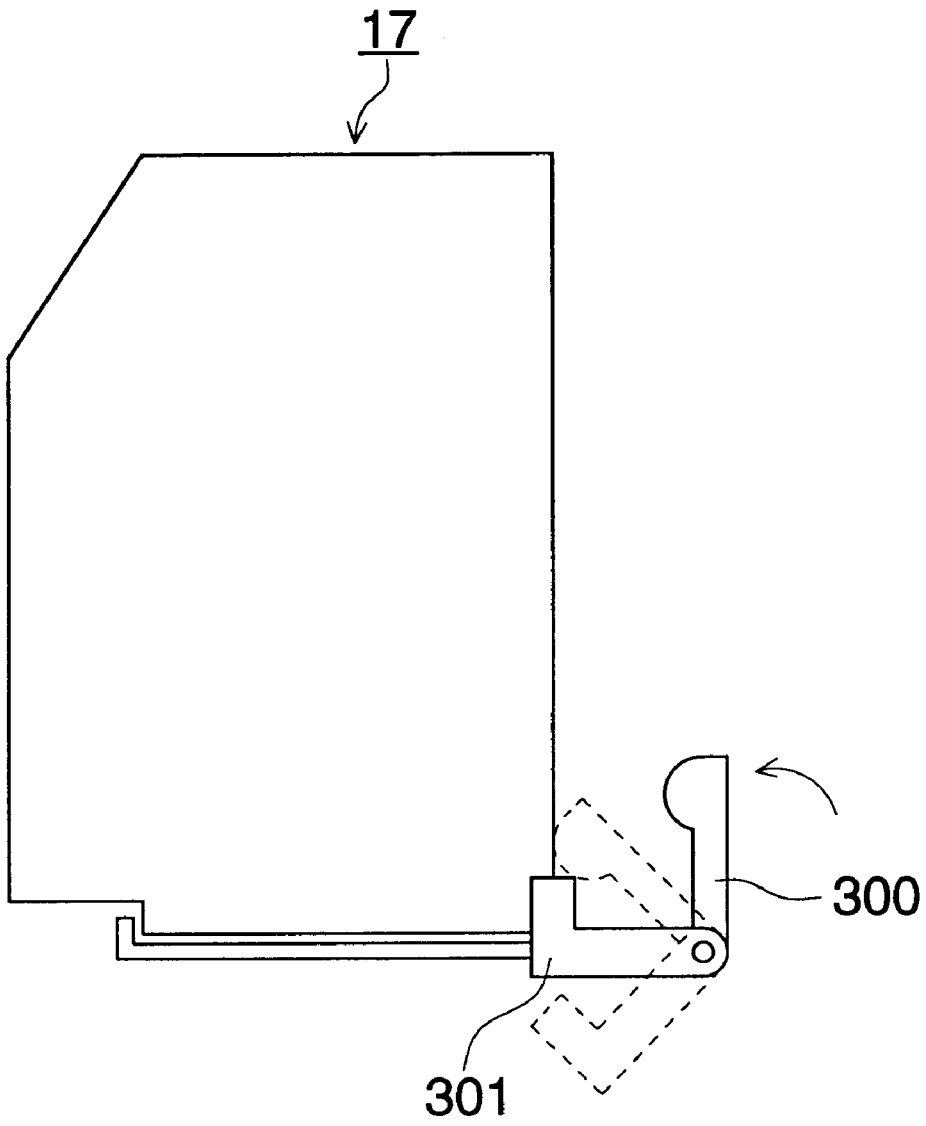
FIG. 21 is a drawing showing a fixing device detaching mechanism in the above-mentioned Embodiment 3.

Embodiment 3 related to the fixing device will be explained referring to FIGS. 20 and 21. For members identical to the above-mentioned Embodiment 1, the same numerals were used.

The present Embodiment is so structured that fixing device is withdrawn after withdrawing transfer sheet separation claw 20 and spurred wheels 21*a* and 21*b*. By rotating handle 300 counterclockwise as shown by an arrow in FIG. 21, stopping plate 301, which hinders fixing device 17 from withdrawing, that is integrated with handle 300, is withdrawn so that withdrawing of fixing device 17 becomes possible. Integral with handle 300, operation lever 163 rotates counterclockwise so that pin 162 provided on conveyance section 160 is pressed. Conveyance section 160 is caused to move to the left. Spurred wheels 21*a* and 21*b* and sheet separation claw 20, which are supported by conveyance section 160, are thereby also caused to retreat to the left.

Embodiment 4

Figure 22:
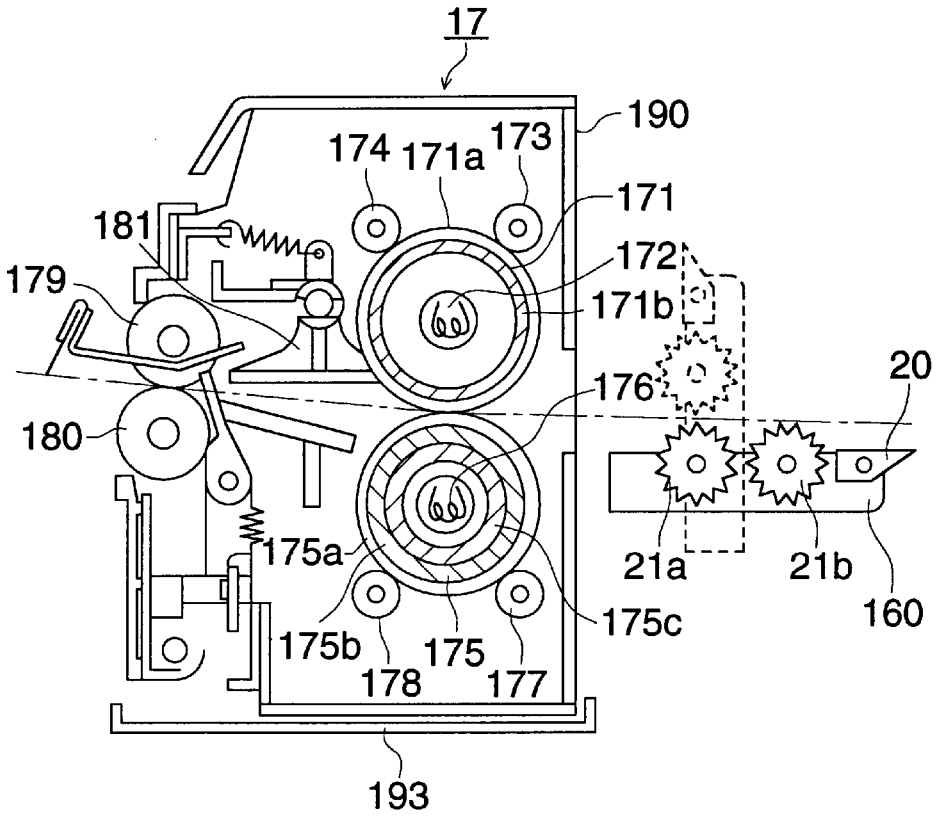
FIG. 22 is a cross sectional view showing a fixing device in Embodiment 4 related to the fixing device of the present invention.
Figure 23:
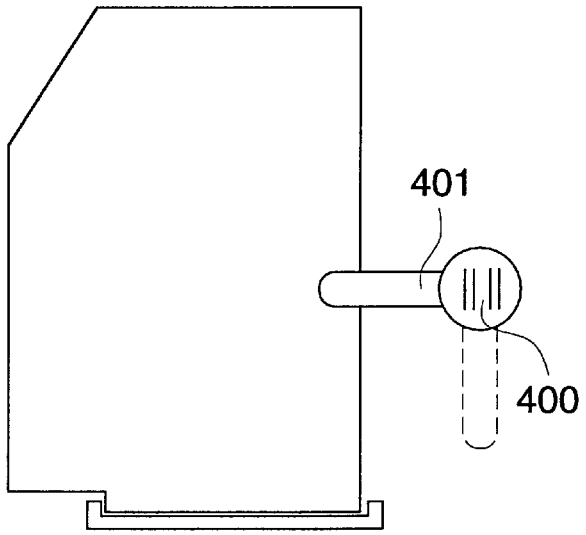
FIG. 23 is a drawing showing a fixing device detaching mechanism in the above-mentioned Embodiment 4.

Embodiment 4, related to the fixing device, will be explained referring to FIGS. 22 and 23. For members identical to the above-mentioned Embodiment 1, the same numerals were used.

The present Embodiment is also so structured that fixing device 17 is withdrawn after withdrawing transfer sheet separation claw 20 and spurred wheels 21*a* and 21*b*. By rotating knob 400 counterclockwise as shown by an arrow in FIG. 21 so that stopping plate 401 is caused to rotate from the position of the solid line to the position of dotted line, withdrawal of fixing device 17 becomes possible. Due to rotation of knob 400, conveyance section 160 integral with knob 400, which has, bearing transfer sheet separation claws 20 and spurred wheels 21*a* and 21*b*, rotates to achieve the state as shown by the dotted line in FIG. 22. Due to the above-mentioned operation in which the fixing device can be withdrawn, separation claws 20 and spurred wheels 21*a* and 21*b* are separated from toner image receiving body 14*a* to be withdrawn.

Due to a setting either that the conveyance section including the guiding means such as the transfer sheet separation claws for ensuring separation of the transfer sheet from the toner image receiving body, the toner image receiving body and the spurred wheels guiding the transfer sheet between the fixing device are withdrawn integrally with the fixing device or that the fixing device cannot be withdrawn unless the conveyance section including the separation claw and the guiding means are retreated, aforesaid retraction is caused to be related to the withdrawal of the fixing device from the image forming apparatus. If the fixing device is withdrawn from the image forming apparatus or removed from the image forming apparatus in order to clear jamming problem, damaging on the toner image receiving body, the transfer sheet separation claw or the guiding member can surely be prevented. In addition, paper jams can be cleared easily.

What is claimed is:

1. An image forming apparatus comprising:

(a) a first image carrying means for carrying a toner image formed by a toner image forming means;

(b) a second image carrying means for carrying thereon the toner image transferred from the first image carrying means, and for conveying a transfer material thereon;

(c) a first transfer means for transferring the toner image carried on the first image carrying means onto the second image carrying means or onto a front side of the transfer material;

(d) a second transfer means for transferring the toner image carried on the second image carrying means onto a back side of the transfer material;

(e) a fixing means for fixing the toner images transferred on the transfer material, wherein the second image carrying means has a curved portion at an edge thereof facing the fixing means; and (f) a conveyance section provided between the curved portion and the fixing means, having a claw member provided adjacent to the curved portion for lifting a leading edge of the transfer material conveyed along the curved portion, wherein the claw member is separated from the curved portion when the conveyance section is moved away from the second image carrying means.

2. The image forming apparatus of claim 1, wherein the claw member is separated from the curved portion of the second image carrying means by being moved toward the fixing means.

3. The image forming apparatus of claim 1, wherein the claw member is separated from the curved portion of the second image carrying means by being moved toward a conveyance path of the transfer material.

4. The image forming apparatus of claim 1, further comprising a claw member leading edge position regulating means for regulating a leading edge position of the claw member when the claw member is near the curved portion.

5. The image forming apparatus of claim 1, further comprising a spurred wheel member rotatably supported and having a plurality of protrusions on a circumferential surface thereof for guiding the back side of the transfer material.

6. The image forming apparatus of claim 5, wherein the spurred wheel is withdrawn in a direction away from a conveyance path of the transfer material.

7. The image forming apparatus of claim 1, wherein the conveyance section further comprises a spurred wheel member rotatably supported and having a plurality of protrusions on a circumferential surface thereof for guiding the back side of the transfer material, and conveyance section is withdrawn in a direction away from a conveyance path of the transfer material.

8. The image forming apparatus of claim 7, wherein the conveyance section still further comprises a transfer sheet holding means for holding the back side of the transfer material.

9. The image forming apparatus of claim 1, wherein the conveyance section further comprises a spurred wheel member rotatably supported and having a plurality of protrusions on a circumferential surface thereof for guiding the back side of the transfer material, and conveyance section is withdrawn so that the claw member does not contact the curved portion.

10. The image forming apparatus of claim 9, wherein the conveyance section is withdrawn by being inclined in a conveying direction of the transfer material.

11. The image forming apparatus of claim 9, wherein the conveyance section is withdrawn by being inclined in a direction perpendicular to a conveying direction of the transfer material.

12. The image forming apparatus of claim 9, wherein the conveyance section is withdrawn by being folded away from the back side of the transfer material.

13. The image forming apparatus of claim 1, further comprising a moving means for moving a part of the conveyance section adjacent to the fixing means so that a conveyance path of the transfer material corresponding to said part is exposed.

14. The image forming apparatus of claim 1, wherein the claw member is withdrawn from the curved portion when the fixing means is removed from the image forming apparatus.

15. The image forming apparatus of claim 14, further comprising a supporting member integrated to the fixing means for supporting the claw member, wherein when the fixing means is removed from the apparatus, the claw member is withdrawn from the curved portion and removed from the apparatus.

16. The image forming apparatus of claim 14, wherein the fixing means is pulled out from the apparatus after the claw member is moved and separated from the curved portion.

17. The image forming apparatus of claim 14, wherein the fixing means can be pulled out from the apparatus only after the claw member is moved and separated from the curved portion.

18. The image forming apparatus of claim 14, further comprising a spurred wheel member provided between the claw member and the fixing means for guiding the transfer material on which the unfixed toner images are carried onto the fixing means, wherein the spurred wheel is provided on a supporting member on which the claw member is also supported.

19. The image forming apparatus of claim 1, wherein when the fixing means is removed from the apparatus, the conveyance section is withdrawn.

20. The image forming apparatus of claim 19 further comprising a supporting member integrated to the fixing means for supporting the conveyance section, wherein when the fixing means is removed from the apparatus, the conveyance section is withdrawn from the curved portion and removed from the apparatus.

21. The image forming apparatus of claim 19, wherein the fixing means is pulled out from the apparatus after the conveyance section is moved and separated from the curved portion.

22. The image forming apparatus of claim 19, wherein the fixing means can be pulled out from the apparatus only after the conveyance section is moved and separated from the curved portion.

23. An image forming apparatus comprising:

(a) a first image carrying means for carrying a first toner image formed by a toner image forming means;

(b) a second image carrying means for carrying thereon a second toner image, and for conveying a transfer material thereon;

(c) a first transfer means for transferring the first toner image carried on the first image carrying means onto a front side of the transfer material;

(d) a second transfer means for transferring the second toner image carried on the second image carrying means onto a back side of the transfer material;

(e) a fixing means for fixing the toner images transferred on the transfer material, wherein the second image carrying means has a curved portion at an edge thereof facing the fixing means; and (f) a conveyance section provided between the curved portion and the fixing means, having a claw member provided adjacent to the curved portion for lifting a leading edge of the transfer material conveyed along the curved portion, wherein the claw member is separated from the curved portion when the conveyance section is moved away from the second image carrying means.

* * * * *